US009916731B2

(12) United States Patent
Allen, II et al.

(10) Patent No.: US 9,916,731 B2
(45) Date of Patent: Mar. 13, 2018

(54) GAMING SYSTEM AND METHOD PROVIDING A CARD GAME WITH EXTRA DRAWS FOR WINNING HANDS

(71) Applicant: IGT, Las Vegas, NV (US)

(72) Inventors: Thomas W. Allen, II, Reno, NV (US); Benjamin R. Holsclaw, Sparks, NV (US); James A. Sipaila, Reno, NV (US)

(73) Assignee: IGT, Las Vegas, NV (US)

( * ) Notice: Subject to any disclaimer, the term of this patent is extended or adjusted under 35 U.S.C. 154(b) by 839 days.

(21) Appl. No.: 14/171,247

(22) Filed: Feb. 3, 2014

(65) Prior Publication Data

US 2015/0221181 A1 Aug. 6, 2015

(51) Int. Cl.
*G07F 17/32* (2006.01)

(52) U.S. Cl.
CPC ..... *G07F 17/3293* (2013.01); *G07F 17/326* (2013.01); *G07F 17/3244* (2013.01)

(58) Field of Classification Search
None
See application file for complete search history.

(56) References Cited

U.S. PATENT DOCUMENTS 1,527,929 A 2/1925 Simons
5,100,137 A 3/1992 Fulton et al.
5,167,413 A 12/1992 Fulton et al.
5,251,897 A 10/1993 Fulton et al.
5,322,295 A 6/1994 Cabot et al.
5,374,067 A 12/1994 Jones et al.
5,377,973 A 1/1995 Jones et al.
5,380,012 A 1/1995 Jones et al.
5,382,025 A 1/1995 Sklansky et al.
5,411,257 A 5/1995 Fulton et al.
5,431,408 A 7/1995 Adams et al.
5,437,451 A 8/1995 Fulton et al.
5,531,448 A 7/1996 Moody et al.
5,636,842 A 6/1997 Cabot et al.
5,732,950 A 3/1998 Moody et al.
5,755,621 A 5/1998 Marks et al.
5,820,460 A 10/1998 Fulton et al.
5,823,873 A 10/1998 Moody
5,833,536 A 11/1998 Davids et al.
5,882,259 A 3/1999 Holmes et al.
(Continued)

*Primary Examiner* — Tramar Harper
(74) *Attorney, Agent, or Firm* — Neal, Gerber & Eisenberg LLP

(57) ABSTRACT

Various embodiments of the present disclosure are directed to a gaming system and method providing a card game with an extra award for each winning hand including one or more extra hands of cards or a modifier for an extra award. In various embodiments, if the first hand includes any winning card combination from a first set of designated winning card combinations, the gaming system provides one or more extra hands of cards, wherein each extra hand initially includes one or more cards from the first hand and then provides one or more extra draws of cards to complete that extra hand. In various embodiments, when the first hand includes any winning card combination from a second set of designated winning card combinations, the gaming system provides a multiplier value which the gaming system applies to the award for the winning card combination from the first hand of cards.

25 Claims, 13 Drawing Sheets

(56) References Cited

U.S. PATENT DOCUMENTS 5,911,418 A 6/1999 Adams et al.
5,954,335 A 9/1999 Moody
5,957,774 A 9/1999 Holmes et al.
6,007,066 A 12/1999 Moody
6,050,658 A 4/2000 O'Sullivan et al.
6,062,979 A 5/2000 Inoue
6,062,981 A 5/2000 Luciano
6,098,985 A 8/2000 Moody
6,113,492 A 9/2000 Walker et al.
6,135,883 A 10/2000 Hachquet
6,193,235 B1 2/2001 Vancura et al.
6,238,288 B1 5/2001 Walker et al.
6,270,405 B1 8/2001 Ferguson et al.
6,290,603 B1 9/2001 Luciano, Jr.
6,311,978 B1 11/2001 Moody
6,394,902 B1 5/2002 Glavich et al.
6,406,023 B1 6/2002 Rowe
6,419,578 B1 * 7/2002 Moody ..... G07F 17/3293 273/274
6,443,452 B1 9/2002 Brune
6,468,156 B1 10/2002 Hughs-Baird et al.
6,474,645 B2 11/2002 Tarantino
6,517,074 B1 * 2/2003 Moody ..... G07F 17/3293 273/274
6,561,898 B2 5/2003 Moody
6,568,680 B1 5/2003 Moody et al.
6,569,013 B1 5/2003 Taylor
6,612,927 B1 9/2003 Slomiany et al.
6,652,377 B1 11/2003 Moody
6,672,959 B2 1/2004 Moody et al.
6,695,700 B2 2/2004 Walker et al.
6,712,693 B1 3/2004 Hettinger
6,726,427 B2 4/2004 Jarvis et al.
6,726,561 B2 * 4/2004 Crawford ..... A63F 3/00157 273/138.1
6,729,961 B1 5/2004 Millerschone
6,746,016 B2 6/2004 Perrie et al.
6,802,778 B1 10/2004 Lemay et al.
6,916,245 B1 7/2005 Vancura et al.
6,935,950 B2 8/2005 Tarantino
6,955,356 B2 10/2005 Moody
6,964,418 B2 11/2005 Moody et al.
6,969,316 B2 11/2005 Jarvis et al.
6,991,538 B2 1/2006 Cannon
6,994,624 B2 2/2006 Gold et al.
7,052,395 B2 5/2006 Glavich et al.
7,059,965 B2 6/2006 Jackson
7,066,814 B2 6/2006 Glavich et al.
7,137,628 B2 11/2006 Moody
7,156,397 B2 1/2007 Moody et al.
7,198,569 B2 4/2007 Wolf et al.
7,222,857 B2 5/2007 Moody
7,222,858 B2 5/2007 Moody
7,247,092 B2 7/2007 Jarvis et al.
7,258,611 B2 8/2007 Bigelow, Jr. et al.
RE39,817 E 9/2007 Walker et al.
7,297,057 B2 11/2007 Gerrard et al.
7,354,344 B2 4/2008 Paulsen et al.
7,384,334 B2 6/2008 Glavich et al.
7,387,568 B2 6/2008 Millerschone et al.
7,390,258 B2 6/2008 Millerschone
7,404,762 B2 7/2008 Moody
7,419,162 B2 9/2008 Lancaster et al.
7,431,644 B2 10/2008 Moody
7,452,272 B2 11/2008 Walker et al.
7,488,251 B2 2/2009 Kaminkow
7,524,243 B2 4/2009 Bansemer et al.
7,563,167 B2 7/2009 Walker et al.
7,588,496 B2 9/2009 Van Asdale
7,641,197 B2 1/2010 Jackson
7,658,672 B1 2/2010 Wolf et al.
7,682,246 B2 3/2010 Cregan et al.
7,727,061 B2 6/2010 Taylor
7,731,584 B2 6/2010 Glavich et al.
7,740,533 B2 6/2010 Walker et al.
7,740,534 B2 6/2010 Walker et al.
7,749,059 B2 7/2010 Tarantino
7,771,274 B2 8/2010 Walker et al.
7,785,188 B2 8/2010 Cannon
7,803,041 B2 9/2010 Gold et al.
7,803,043 B2 9/2010 Jackson
7,815,500 B2 10/2010 Montross et al.
7,828,648 B2 11/2010 Jackson
7,837,545 B2 11/2010 Blair, Jr. et al.
7,857,693 B1 12/2010 Johnson et al.
7,862,423 B2 1/2011 Walker et al.
7,927,204 B2 4/2011 DeBrabander, Jr. et al.
7,993,191 B2 8/2011 Evans et al.
8,002,621 B2 8/2011 Mattice et al.
8,021,222 B2 9/2011 Walker et al.
8,029,358 B2 10/2011 Bigelow, Jr. et al.
8,062,119 B2 11/2011 Stern et al.
RE43,037 E 12/2011 Walker et al.
8,083,578 B2 12/2011 Jackson
8,092,290 B2 1/2012 Darby
8,092,291 B2 1/2012 Gerrard et al.
8,100,748 B2 1/2012 Montross et al.
8,123,604 B2 2/2012 Lancaster et al.
8,137,174 B2 3/2012 Nicely et al.
8,142,274 B2 3/2012 Baerlocher
8,147,310 B2 4/2012 Jarvis et al.
8,152,615 B2 4/2012 Lancaster et al.
8,157,631 B2 4/2012 Lancaster et al.
8,172,660 B2 5/2012 Lancaster et al.
8,177,616 B2 5/2012 Nicely
8,177,619 B2 5/2012 Jackson
8,197,319 B2 6/2012 Nicely
8,197,321 B2 6/2012 Wolf et al.
8,210,532 B2 7/2012 Evans et al.
8,210,533 B2 7/2012 Evans et al.
8,210,928 B2 7/2012 Walker et al.
8,216,039 B2 7/2012 Nicely et al.
8,221,214 B2 7/2012 Nicely
8,226,469 B2 7/2012 Pawloski et al.
8,231,454 B2 7/2012 Caputo
8,231,456 B2 7/2012 Zielinski
8,235,781 B2 8/2012 Moody
8,262,455 B2 9/2012 Caputo et al.
8,262,459 B2 9/2012 Mattice et al.
8,262,460 B2 9/2012 Mattice et al.
8,277,305 B2 10/2012 Caputo et al.
8,308,549 B2 11/2012 Baerlocher et al.
8,317,597 B2 11/2012 Taylor
8,328,614 B2 12/2012 Jones et al.
8,328,623 B2 12/2012 Stern et al.
8,342,941 B2 1/2013 Nicely
8,353,751 B2 1/2013 Bickley et al.
8,382,578 B2 2/2013 Mattice et al.
8,398,472 B2 3/2013 Bansemer et al.
8,398,473 B2 3/2013 Baerlocher et al.
8,403,739 B2 3/2013 Jackson
8,419,518 B2 4/2013 Jarvis et al.
8,419,525 B2 4/2013 Caputo et al.
8,439,739 B2 5/2013 Walker et al.
8,439,748 B2 5/2013 Walker et al.
8,444,465 B2 5/2013 Macaulay
8,449,362 B2 5/2013 Jackson
8,449,363 B2 5/2013 Baerlocher et al.
8,449,364 B2 5/2013 Lancaster et al.
8,454,429 B2 6/2013 Jaffe et al.
8,460,093 B2 6/2013 Jackson
8,460,094 B2 6/2013 Bigelow, Jr. et al.
8,475,253 B1 7/2013 Cole
8,475,255 B2 7/2013 Wolf et al.
8,500,546 B2 8/2013 Walker et al.
8,556,697 B2 10/2013 Paulsen et al.
8,608,543 B2 12/2013 Cuddy et al.
2003/0064768 A1 * 4/2003 Fier ..... G07F 17/32 463/13
2003/0078092 A1 * 4/2003 Bennett ..... G07F 17/32 463/20
2004/0116171 A1 * 6/2004 Moody ..... A63F 3/00157 463/13
2004/0242313 A1 12/2004 Munoz

(56) References Cited

U.S. PATENT DOCUMENTS

2005/0096121 A1 5/2005 Gilliland et al.
2005/0096123 A1 5/2005 Cregan et al.
2005/0164777 A1 7/2005 Daly
2005/0208992 A1 9/2005 Randall
2006/0040728 A1 2/2006 Fuller
2006/0128456 A1* 6/2006 Berman ..... G07F 17/3244 463/13
2006/0246977 A1* 11/2006 Cannon ..... G07F 17/34 463/13
2006/0258423 A1* 11/2006 Englman ..... G07F 17/32 463/11
2007/0243921 A1 10/2007 Fanjoy et al.
2007/0275778 A1 11/2007 Fong et al.
2007/0287532 A1* 12/2007 Jackson ..... G07F 17/32 463/25
2008/0102923 A1 5/2008 Esses et al.
2008/0111309 A1 5/2008 Nicely et al.
2008/0188278 A1 8/2008 Paulsen et al.
2008/0220851 A1 9/2008 Glavich et al.
2009/0042652 A1 2/2009 Baerlocher et al.
2009/0088239 A1 4/2009 Iddings et al.
2009/0104977 A1* 4/2009 Zielinski ..... G07F 17/3267 463/25
2010/0016055 A1 1/2010 Englman
2010/0099480 A1 4/2010 Caputo
2010/0117299 A1 5/2010 Nicely et al.
2010/0120484 A1 5/2010 Caputo et al.
2010/0120506 A1 5/2010 Davis et al.
2011/0021266 A1 1/2011 Jaffe et al.
2011/0045894 A1 2/2011 Owen
2011/0111818 A1 5/2011 Baerlocher
2011/0111819 A1* 5/2011 Moody ..... G07F 17/32 463/13
2011/0111824 A1 5/2011 Cuddy et al.
2011/0111826 A1 5/2011 Baerlocher et al.
2011/0118010 A1 5/2011 Brune
2012/0122534 A1 5/2012 Montross et al.
2012/0149451 A1 6/2012 Nicely et al.
2012/0157180 A1 6/2012 Baerlocher
2012/0270622 A1 10/2012 Pawloski et al.
2012/0276971 A1 11/2012 Nicely et al.
2012/0282996 A1 11/2012 Nicely et al.
2012/0295683 A1 11/2012 Moody
2013/0005426 A1 1/2013 Nicely
2013/0053126 A1 2/2013 Baerlocher et al.
2013/0072274 A1 3/2013 Taylor
2013/0079087 A1 3/2013 Brosnan et al.
2013/0116033 A1 5/2013 Nicely
2013/0130769 A1 5/2013 Taylor
2013/0157733 A1 6/2013 Thorne et al.
2013/0172064 A1 7/2013 Bansemer et al.
2013/0172065 A1 7/2013 Jackson
2013/0196745 A1 8/2013 Baerlocher et al.
2013/0217457 A1 8/2013 Jarvis et al.
2013/0225258 A1 8/2013 Caputo et al.
2013/0231170 A1 9/2013 Macaulay
2013/0244755 A1 9/2013 Walker et al.
2013/0260855 A1 10/2013 Jackson et al.
2013/0260869 A1 10/2013 Basallo et al.
2013/0267292 A1 10/2013 Baerlocher et al.
2013/0267293 A1 10/2013 Jackson et al.
2013/0273991 A1 10/2013 Wolf et al.
2013/0288765 A1 10/2013 Cole et al.
2013/0310126 A1 11/2013 Daniels et al.
2013/0310164 A1 11/2013 Walker et al.
2013/0316807 A1 11/2013 Walker et al.
2013/0331171 A1 12/2013 Brune et al.
2015/0170476 A1* 6/2015 Allen, II ..... G07F 17/3225 463/13
2015/0206398 A1* 7/2015 Bansemer ..... G07F 17/3293 463/13

* cited by examiner

GAMING SYSTEM AND METHOD PROVIDING A CARD GAME WITH EXTRA DRAWS FOR WINNING HANDS

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

In recent years, poker has become very popular. One of the most common variations of poker is Five Card Draw. In general, in Five Card Draw poker the player receives five cards dealt face up from a fifty-two card deck of playing cards. The player can discard none, one, a plurality, or all of the five cards. Each discarded card is replaced with another card from the deck. After the replacement (if any), the cards are evaluated for winning combinations. For a five-card poker game, there are typically ten general categories of hands, ranked from highest to lowest, as shown in Table 1 below.

TABLE 1

Ranking of Five Card Poker Hands by Category

| Rank | Name | Example |
|---|---|---|
| 1 | Royal Straight Flush | A♣K♣Q♣J♣10♣ |
| 2 | Straight Flush | K♣Q♣J♣10♣9♣ |
| 3 | Four of a Kind | J♣J♥J♦J♠3♣ |
| 4 | Full House | A♥A♦A♣6♦6♣ |
| 5 | Flush | A♣J♣8♣6♣2♣ |
| 6 | Straight | 8♦7♣6♠5♠4♣ |
| 7 | Three of a Kind | Q♠Q♥Q♦6♦2♠ |
| 8 | Two Pair | 8♦8♥5♥5♣2♠ |
| 9 | One Pair | K♦K♠8♣7♣2♥ |
| 10 | High Card | A♥10♣7♦5♠3♠ |

Within each category, hands are ranked according to the rank of individual cards, with an Ace being the highest card and a Two being the lowest card. There is no difference in rank between the four suits of cards. All hands can be ranked in a linear ranking from highest to lowest. Because suits are all of the same value, however, there are multiple hands that have identical rankings. For example, there are four equivalent hands for each type of Straight Flush, Four of a Kind, or Flush. There are over a hundred equivalent hands for each Two Pair variation, and there are over 1,000 equivalent hands for each type of no-pair hand.

Numerous variations of poker exist, including Five Card Draw as mentioned above, Three Card Poker, Five Card Stud, Seven Card Stud, Hold 'Em (also called Texas Hold 'Em), Omaha (also called Omaha Hold 'Em), and Pai-Gow Poker. These games generally differ in the manner in which cards are dealt and in the manner and frequency in which bets are placed. Various criteria may also be used to determine the winning hand, including the highest ranking hand, the lowest ranking hand (Low-Ball), and where the highest ranking and lowest ranking hands each win half of the pot (High-Low).

In certain known multiplayer variations of poker, players play against each other rather than against a dealer or house.

In certain of these variations, a round of play begins when each player has placed an initial bet, which is typically referred to as the ante, into the pot. The term pot typically refers to the total accumulation of antes and wagers made during a particular game. In other poker variations, such as Texas Hold 'Em (described in further detail below), only two players at a table make the initial bets, which are commonly referred to as the blinds.

The quantity of cards dealt depends on the particular variation of poker being played. For example, in Five Card Draw, each player is initially dealt five cards. In typical Three Card Poker games where the player plays against a dealer hand, the player is dealt a total of three cards and the dealer hand includes a total of three cards as well. In certain known Three Card Poker games, the initially dealt player hand and dealer hand are final and there is no option to replace or draw any new cards. In Texas Hold 'Em, Five Card Stud and Seven Card Stud, each player is initially dealt two cards. These cards are typically dealt face-down. However, depending on the game, some of the cards may be dealt face-up to the player. For example, in certain versions of Five Card Stud, each player is initially dealt one card face-up and one card face-down. In Texas Hold 'Em, each player is initially dealt two cards face-down, which are commonly referred to as the hole cards.

For certain poker variations in which additional cards are dealt or in which cards may be replaced, after the initial deal, a first round of wagering begins, in which the players have the opportunity to place wagers. If a player places a wager, that wager must be matched (i.e., called) or raised by each player that wants to remain in the game. A raise includes matching the previous wager and increasing the total bet. A player who does not match a bet drops out of the game or folds. A round of betting ends when either every player but one has folded, or when the highest bet or raise has been called by at least one remaining player such that each remaining player has wagered the same amount into the pot during the round.

Depending on the variation of poker being played, each game may have only an initial wager or several rounds of wagering, where each round of wagering is generally preceded by the dealing of one or more cards. A player wins a game of poker by being the last remaining player in the game after all other players have folded or by having the highest ranking hand when a showdown occurs. If two or more players remain alter the final round of wagering is complete, a showdown occurs. During the showdown, each remaining player's hand is displayed, the highest ranking hand is determined to be the winning hand, and the pot is provided to the player having the winning hand. If two or more players have identically ranked hands that are the highest ranking hands, the pot is split evenly among the tying players.

Of the poker variations mentioned above, Texas Hold 'Em is one of the more popular versions. Texas Hold 'Em is generally a multi-player card game played at a live card table or via a computer-based virtual card table. In one version of a live card table game of Texas Hold 'Em, only two players at a table make the initial bets, commonly referred to as the blinds. The blinds include a big blind and a small blind. The big blind is typically twice the value of the small blind. In a blind-based game such as Texas Hold 'Em, all players are initially eligible to receive a hand, even if they do not place the big blind or the small blind. After the players have anted (if an ante is required), each player eligible for play is dealt an initial set of cards. Each of the players must match the blinds, raise the blinds or fold. Texas Hold 'Em includes a designated quantity of community cards (usually five) that can be used by all of the players in combination with their hole cards. However, in certain variations, there may only be three community cards. In certain Texas Hold 'Em games, the community cards are dealt over the course of several wagering rounds. For example, the gaming device or dealer deals the flop (usually three cards), the turn (usually one card), and the river (usually one card). The winning hand is the resulting five card hand (of the combined seven cards) having the highest poker rank. This method of determining a winning five card hand is similar to determining a winning hand in Seven Card Stud. However, Seven Card Stud does not utilize community cards as in Texas Hold 'Em. In other variations of Texas Hold 'Em, where the quantity of community cards is only three, the flop is a single card rather than three cards.

There is a continuing need for new and exciting poker games to keep players engaged during game play, increase entertainment value, and provide additional excitement to players.

SUMMARY

Various embodiments of the present disclosure are directed to a gaming system and method providing a card game wherein if a first hand of cards includes a designated winning card combination, the gaming system provides an extra award including one or more extra hands of cards or a modifier for an extra award. In various embodiments, for each play of the card game, the gaming system employs one or more sets of designated winning card combinations. In various embodiments, when the first hand of cards includes any winning card combination from a first set of designated winning card combinations, the gaming system provides one or more extra hands of cards, wherein each extra hand of cards initially includes one or more cards from the first hand of cards and then provides one or more extra draws of cards to complete that extra hand. When the first hand of cards includes any winning card combination from a second different set of designated winning card combinations, the gaming system provides an award modifier (such as a multiplier value) which the gaming system applies to the award associated with the winning card combination from the first hand of cards. In various embodiments, the gaming system randomly determines the quantity of extra hands and the multiplier value.

More specifically, in one embodiment, the card game is a stud poker game. In this embodiment, there are two sets of designated winning card combinations. The first set of designated winning card combinations includes a predefined set of winning card combinations wherein the winning card combination includes less than five cards and can be improved with one or more additional cards based on a five-card paytable. For example, the first set of designated winning card combinations includes a pair, three-of-a-kind, and two-pairs. The second set of designated winning card combinations includes a second different predefined set of winning card combinations including a four-of-a-kind and any winning card combinations including the five cards from the first hand of cards. For example, in addition to a four-of-a-kind, the second set of designated winning card combinations includes a straight, a full house, and a flush. In this embodiment, for each play of the game, the gaming system (a) randomly selects a first hand of cards; (b) displays the first hand of cards face up; (c) determines any winning card combinations associated with the first hand of cards; and (d) displays any award associated with any winning card combination of the first hand of cards. If the first hand of cards includes any winning card combination from the first set of designated winning card combinations, the gaming system randomly determines a quantity of extra hands of cards for the play of the card game. For each of the extra hands of cards in this embodiment, the gaming system: (1) displays the cards from the winning card combination of the first hand of cards; (2) completes the extra hand of cards with extra cards from another virtual deck of cards, wherein a separate virtual deck of cards is used for each extra hand of cards; (3) determines any extra winning card combination in the extra hand of cards; and (4) displays any awards for any winning card combination in each extra hand of cards.

In this embodiment, if the first hand of cards does not include a winning card combination from the first set of designated winning card combinations, the gaming system determines whether the first hand includes any winning card combination from the second set of designated winning card combinations. If the first hand of cards includes a winning card combination from the second set of designated winning card combinations, the gaming system randomly generates an award modifier (such as a multiplier value) for an extra award. The gaming system applies the randomly generated multiplier value to the award associated with the winning card combination of the first hand of cards. The gaming system provides and displays the award associated with the first hand of cards and the extra award.

It should be appreciated that if the player achieves a winning card combination in the first hand of cards, the gaming system provides and displays the award associated with the winning card combination and the gaming system provides an opportunity for an extra award. The extra award can by any award associated with a new winning card combination in one or more extra hands of cards or an extra award from a multiplier value applied to the award associated with the first hand of cards. It should thus be appreciated that the present disclosure provides an opportunity for multiple awards for a winning hand. As such, the present disclosure provides a new and exciting poker game that keeps players engaged during game play, increases entertainment value, and provides additional player excitement.

Additional features and advantages are described herein, and will be apparent from, the following Detailed Description and the Figures.

DETAILED DESCRIPTION

Card Game with Extra Hands or an Award Modifier

Various embodiments of the present disclosure are directed to a gaming system and method providing a card game with extra awards, wherein if a first hand of cards includes a designated winning card combination, the gaming system provides one or more extra hands or an award modifier (such as a multiplier) for an extra award. While the card game of the present disclosure is employed as a base or primary game in the embodiments described below, it should be appreciated that the card game may additionally or alternatively be employed as or in association with a bonus game or a secondary game. Moreover, while any credit balances, any wagers, and any awards are displayed as amounts of monetary currency, credits, or "chips" representing monetary currency or credits in the embodiments described below, one or more of such credit balances, such wagers, and such awards may be for non-monetary credits, promotional credits, player tracking points or credits, or chips representing any thereof.

While the example card games are variations of stud poker games in certain of the example embodiments described below, it should be appreciated that the present disclosure contemplates employing any other suitable type of card game instead of or in addition to stud poker games.

Figure 1:
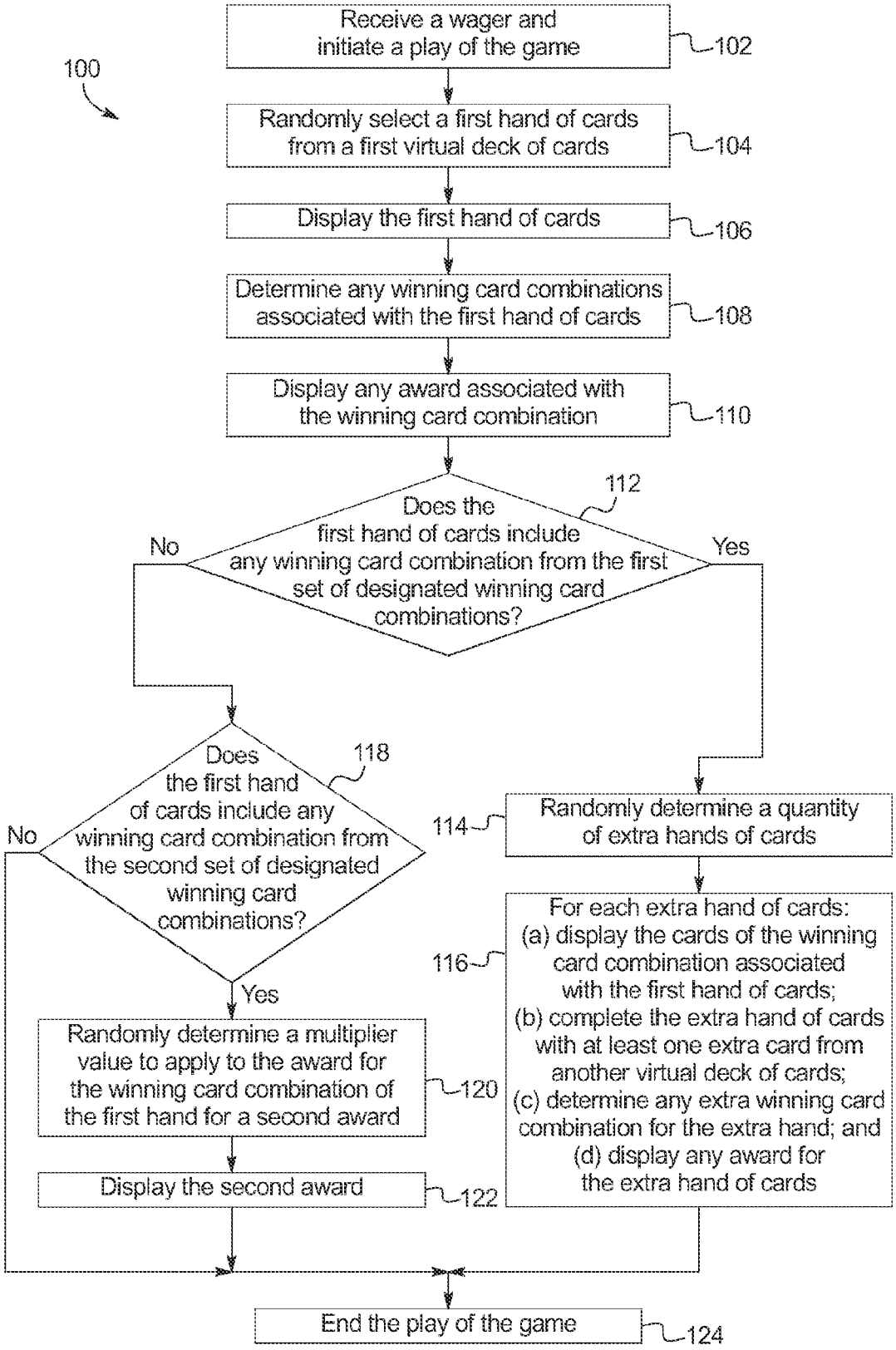
FIG. 1 is a flowchart illustrating a method of operating an example embodiment of the gaming system of the present disclosure configured to operate the card game with an extra award provided by one or more extra hands of cards or a multiplier.

Referring now to FIG. 1, one embodiment of the process or method of operating a gaming system of the present disclosure is generally illustrated, and indicated by numeral 100. In various embodiments, method 100 is represented by a set of instructions stored in one or more memories and executed by one or more processors. Although method 100 is described with reference to the flowchart shown in FIG. 1, it should be appreciated that many other processes of performing the acts associated with this illustrated method 100 may be employed. For example, the order of certain of the illustrated blocks and/or diamonds may be changed, certain of the illustrated blocks and/or diamonds may be optional, and/or certain of the illustrated blocks and/or diamonds may not be employed.

In this example embodiment, the method 100 includes receiving a wager from a player for a play of the card game as indicated by block 102. After receiving the wager, the method 100 includes: (a) randomly selecting a first hand of cards from a first virtual deck of cards, as indicated by block 104; (b) displaying the first hand of cards, as indicated by 106; (c) determining any winning card combinations associated with the first hand of cards, as indicated by block 108; and (d) displaying any award associated with the winning card combination, as indicated by block 110.

The method 100 then includes determining whether the first hand of cards includes any winning card combination from a first set of designated winning card combinations, as indicated by diamond 112. The first set of designated winning card combinations includes a predefined set of winning card combinations. In one example embodiment, the first set of designated winning card combinations includes winning card combinations that include less than five cards and that can be improved with one or more additional cards based on a standard Jacks or Better paytable. For example, the first set of designated winning card combinations includes Jacks or Better, two pair, and three-of-a-kind. If the first hand of cards includes any winning card combination from the first set of designated winning card combinations, the method 100 includes randomly determining a quantity of extra hands of cards, as indicated by block 114. For each extra hand of cards, as shown in block 116, the method 100 includes: (a) displaying the cards of the winning card combination associated with the first hand of cards; (b) completing the extra hand of cards with at least one extra card from another virtual deck of cards; (c) determining any extra winning card combination for the extra hand; and (d) displaying any award associated with the extra hand of cards. This is the primary or first award for the play of the game.

It should be appreciated that in this embodiment the method 100 includes using a separate virtual deck of cards for each hand of cards including the first hand of cards and each extra hand of cards.

If the first hand of cards does not include any winning card combination from the first set of designated winning card combinations, the method 100 includes determining whether the first hand of cards includes any winning card combination from a second set of designated winning card combinations, as indicated by diamond 118. The second set of designated winning card combinations includes a second different predefined set of winning card combinations. In one example embodiment, the second set of designated winning card combinations includes winning card combinations including a four-of-a-kind and any winning card combinations including the five cards from the first hand of cards. For example, in addition to a four-of-a-kind, the second set of designated winning card combinations includes a straight, flush, a full house, straight flush and royal flush. If the first hand of cards includes any winning card combination from the second set of designated winning card combinations, the method 100 includes randomly determining an award modifier (such as a multiplier value) to apply to the award associated with the winning card combination of the first hand of cards for a second award, as indicated by block 120, and displaying a second award in addition to the first award, as indicated by block 122. It should be appreciated that in this embodiment, with a standard deck of 52 cards which does not include any wild cards, certain winning card combinations in the second set of designated winning card combinations (i.e., four-of-a-kind and royal flush) cannot be improved by one or more additional cards from a standard deck of cards. Thus, in this embodiment, for winning card combinations from the second set of designated winning card combinations, the gaming system provides an award modifier instead of extra draws for extra hands of cards.

It should be appreciated that in this embodiment, the second set of designated winning card combinations also includes winning card combinations that can be improved by one or more additional cards from a standard deck of cards, such as the full house, straight, flush and straight flush. It should be appreciated that in certain alternative embodiments, the second set of designated winning card combinations includes only winning card combinations that cannot be improved by one or more additional cards from a standard deck of cards. In an example of such an embodiment, the five-card winning card combinations (i.e., full house, straight, flush and straight flush) that can be improved by one or more additional cards from the standard deck of 52 cards are included in the first set of designated winning card combinations. In another alternative example embodiment, the five-card winning card combinations (i.e., full house, straight, flush and straight flush) that can be improved by one or more additional cards from the standard deck of 52 cards are included in a different third set of designated winning card combinations.

The method 100 then includes ending the play of the card game as indicated by block 124. In other words, if the first hand of cards does not include any winning card combination from either the first or second set of designated winning card combinations, the method 100 includes ending the play of the card game. It should be appreciated that for each play of the card game, for a designated winning first hand of cards, the method 100 includes providing an extra award by providing extra hands of cards or a multiplier value to apply to the award associated with the first hand of cards. Thus, the method 100 provides the player multiple awards for each winning hand. As such, the present disclosure provides a game that keeps players excited and engaged.

Turning now to FIGS. 2A, 2B, 2C, 20, and 2E, which illustrate screen shots of one example embodiment of the gaming system of the present disclosure providing the card game with extra awards including one or more extra hands or a multiplier in accordance with method 100 as described above with respect to FIG. 1. In this example embodiment, the gaming system display 200 displays a plurality of meters including meters which indicate the player's balance 202, the player's primary bet 204, the player's secondary bet 206, and the total award 208 for each hand. In this example embodiment, the display 200 also shows an extra award number display 212. In this example embodiment, the card game is a standard Jacks or Better stud poker game.

Figure 2A:
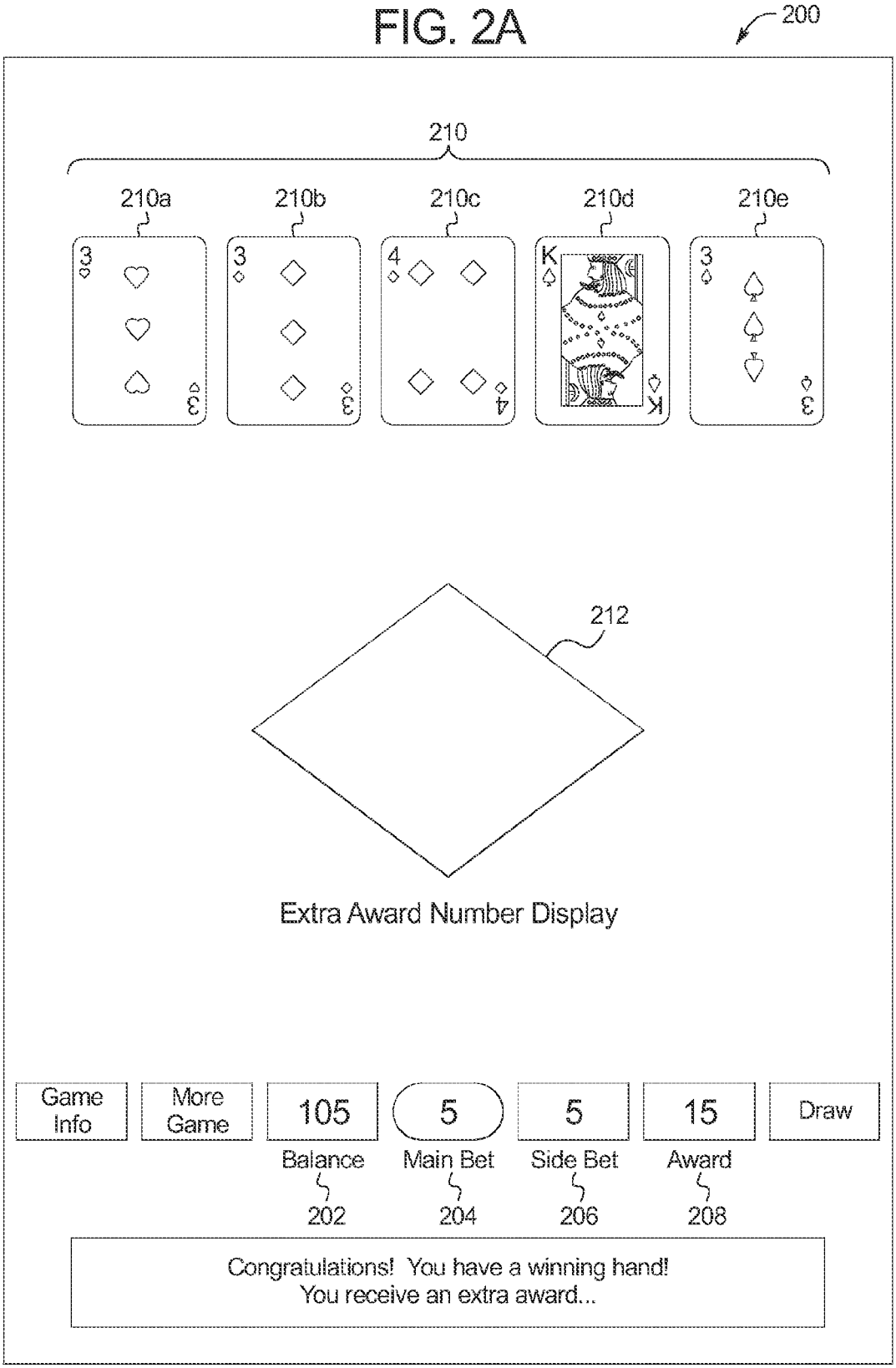
FIGS. 2A, 2B, 2C, 2D and 2E illustrate screen shots of an example of one embodiment of the gaming system of the present disclosure providing a play of the card game with an extra award provided by one or more extra hands of cards or a multiplier according to the method of FIG. 1.

As illustrated in FIG. 2A, in this embodiment, the player places a primary wager of 5 credits, as indicated by 204, and a secondary wager of five credits, as indicated by 206. In this embodiment, the secondary wager funds the extra award feature. Upon receiving a wager from a player for a play of the card game, the gaming system of this example embodiment randomly selects a first hand of cards 210 including five cards 210*a*, 210*b*, 210*c*, 210*d*, and 210*e* from a first virtual deck of 52 cards and displays the first hand of cards 210 face up as shown in the display 200. More specifically, in this example embodiment, the gaming system displays the first hand of cards including the: 3♥, 3♦, 4♦, K♠, and 3♠, as indicated by 210*a*, 210*b*, 210*c*, 210*d* and 210*e*. In this example embodiment, the first hand of cards includes a winning card combination (i.e., 3♥, 3♦, and 3♠) based on the example Jacks or Better paytable as shown below. Since the first hand of cards includes a winning card combination, based on the 5 credit primary wager, the gaming system provides and displays an award of 15 credits as indicated by 208,

TABLE 2

Example Jacks or Better Paytable

| | 1 Credit | 2 Credits | 3 Credits | 4 Credits | 5 Credits |
|---|---|---|---|---|---|
| Royal Rush | 250 | 500 | 750 | 1000 | 4000 |
| Straight Rush | 50 | 100 | 150 | 200 | 250 |
| Four of a Kind | 25 | 50 | 75 | 100 | 125 |
| Full House | 9 | 18 | 27 | 36 | 45 |
| Flush | 6 | 12 | 18 | 24 | 30 |
| Straight | 4 | 8 | 12 | 16 | 20 |
| Three of a Kind | 3 | 6 | 9 | 12 | 15 |
| Two Pair | 2 | 4 | 6 | 8 | 10 |
| Jacks or Better | 1 | 2 | 3 | 4 | 5 |

Figure 2B:
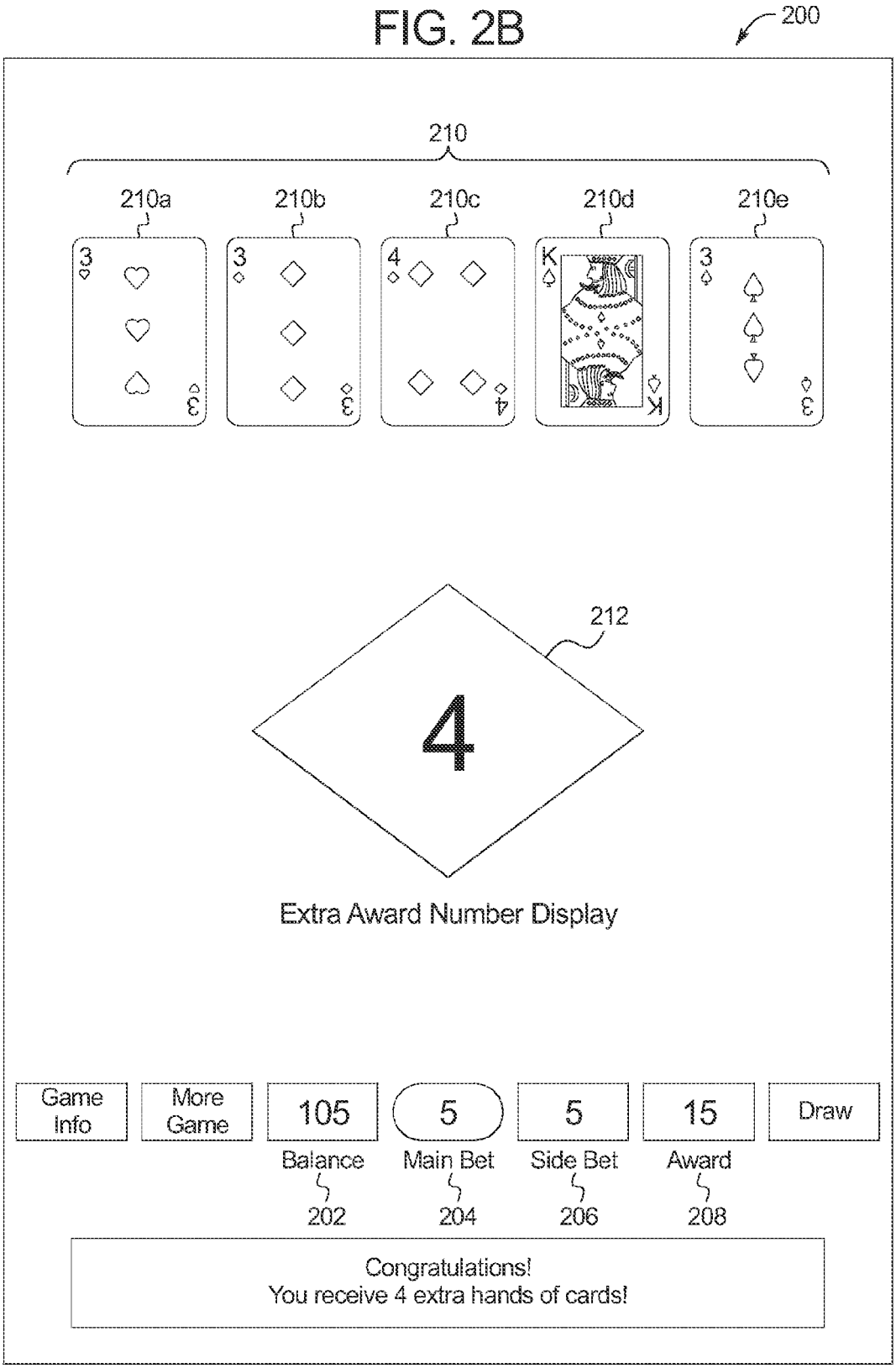

Turning now to FIG. 2B, since the first hand of cards includes a winning card combination, the winning card combination triggers the extra awards feature of the card game. The gaming system determines whether the first hand includes a winning card combination from a first set of designated winning card combinations. The first set of designated winning card combinations includes a predefined set of winning card combinations wherein the winning card combinations include less than five cards and can be improved with one or more additional cards based on a five-card paytable. In this example embodiment, the first hand of cards 210 includes a three-of-a-kind which is a winning card combination including less than five cards and which can be improved to a four-of-a-kind with a 3♣ or to a full house with an additional pair of cards. Since the first hand of cards 210 includes a winning card combination from the first set of designated winning card combinations, the gaming system determines a quantity of extra hands for the play of the card game as indicated by the extra award number display 212. In this example embodiment, the gaming system randomly determines that the player receives four extra hands of cards as indicated by the extra award number display 212.

Figure 2C:
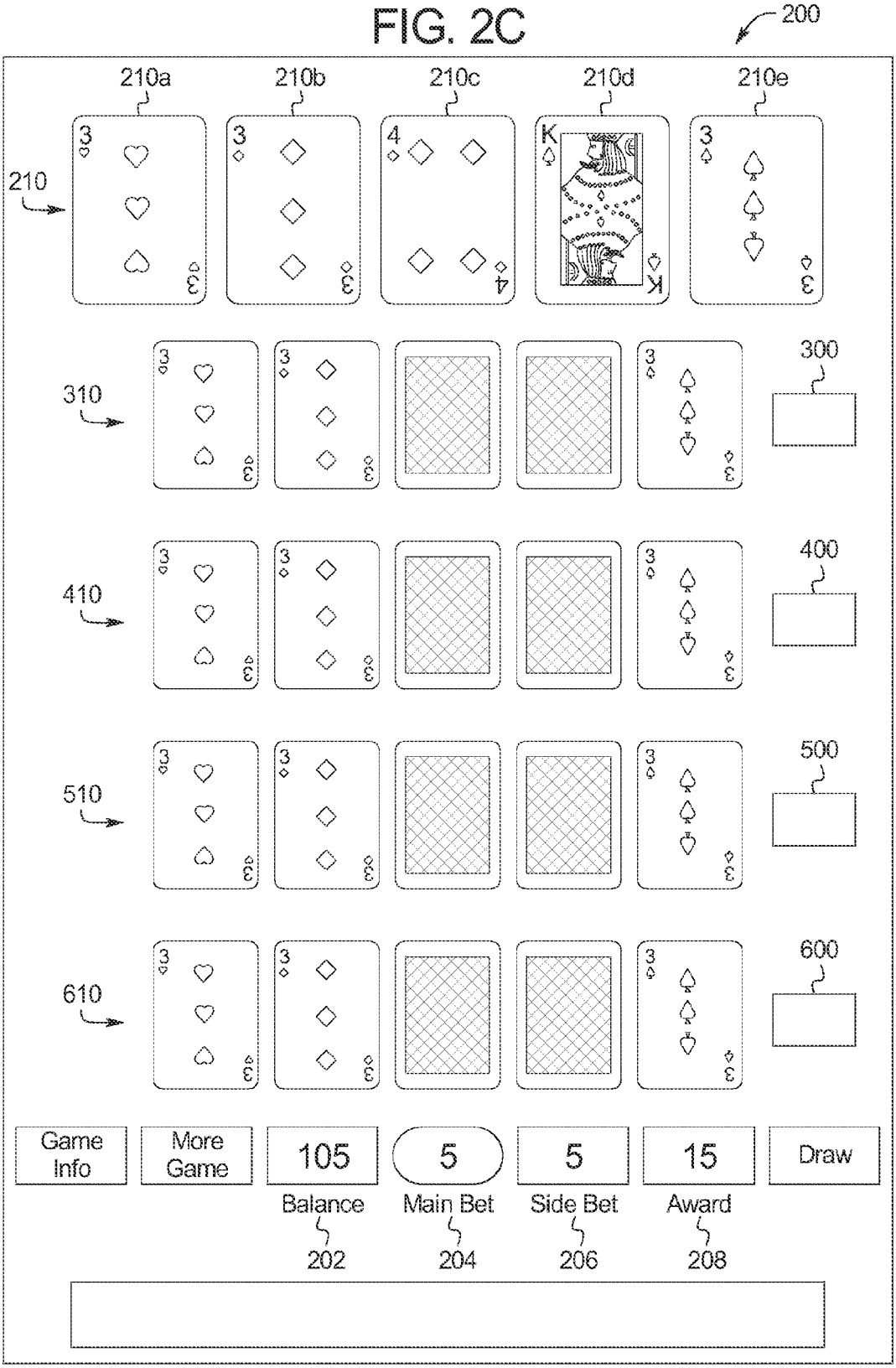
Figure 2D:
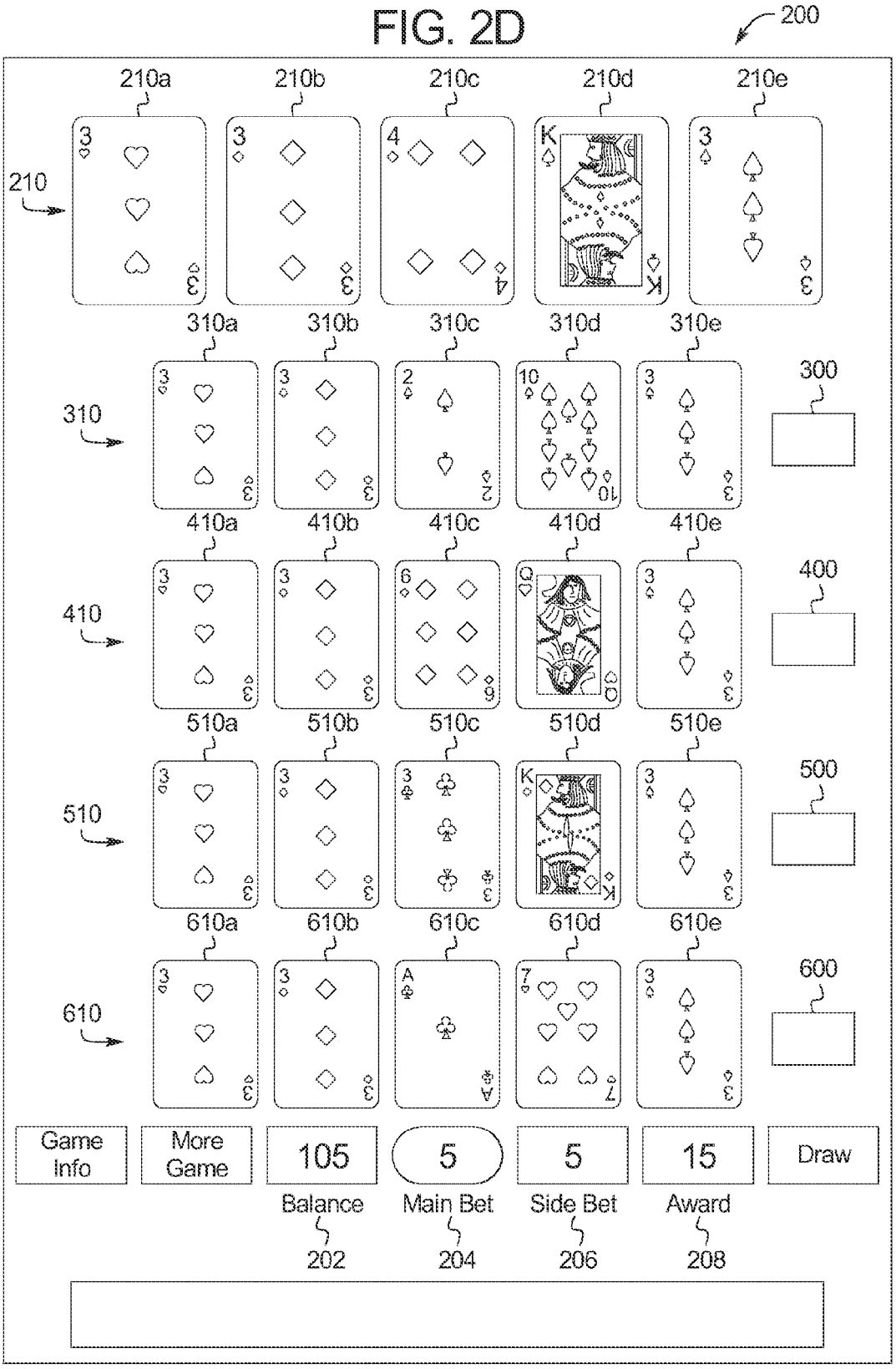

Turning now to FIG. 2C, the gaming system displays four extra hands of cards as indicated by 310, 410, 510, and 610. For each of the four extra hands of cards, the gaming system displays the cards from the first hand of cards. In this embodiment, the gaming system displays the cards from the winning card combination from the first hand of cards 210*a*, 210*b* and 210*e* (i.e., 3♥, 3♦, and 3♠) for each extra hand of cards.

Turning now to FIG. 20, the gaming system completes each extra hand of cards with one or more additional cards from a separate virtual deck of cards. In this example embodiment, for each extra hand of cards the gaming system displays the three cards from the winning card combination of the first hand of cards (i.e., 3♥, 3♦, and 3♠). Thus, the gaming system randomly selects two additional cards for each extra hand of cards. To complete each extra hand of cards of this example embodiment, the gaming system uses a separate virtual deck of 49 cards excluding the three cards from the winning card combination of the first hand of cards (i.e., 3♥, 3♦, and 3♠). In this example embodiment, the first extra hand of cards 310 includes the 3♥, 3♦, 2♠, 10♠, and 3♠. The second extra hand of cards 410 includes 3♥, 3♦, 6♦, Q♥, and 3♠. The third extra hand of cards 510 includes 3♥, 3♦, 3♣, K♦, and 3♠. The fourth extra hand of cards 610 includes 3♥, 3♦, A♣, 7♥, and 3♠.

Figure 2E:
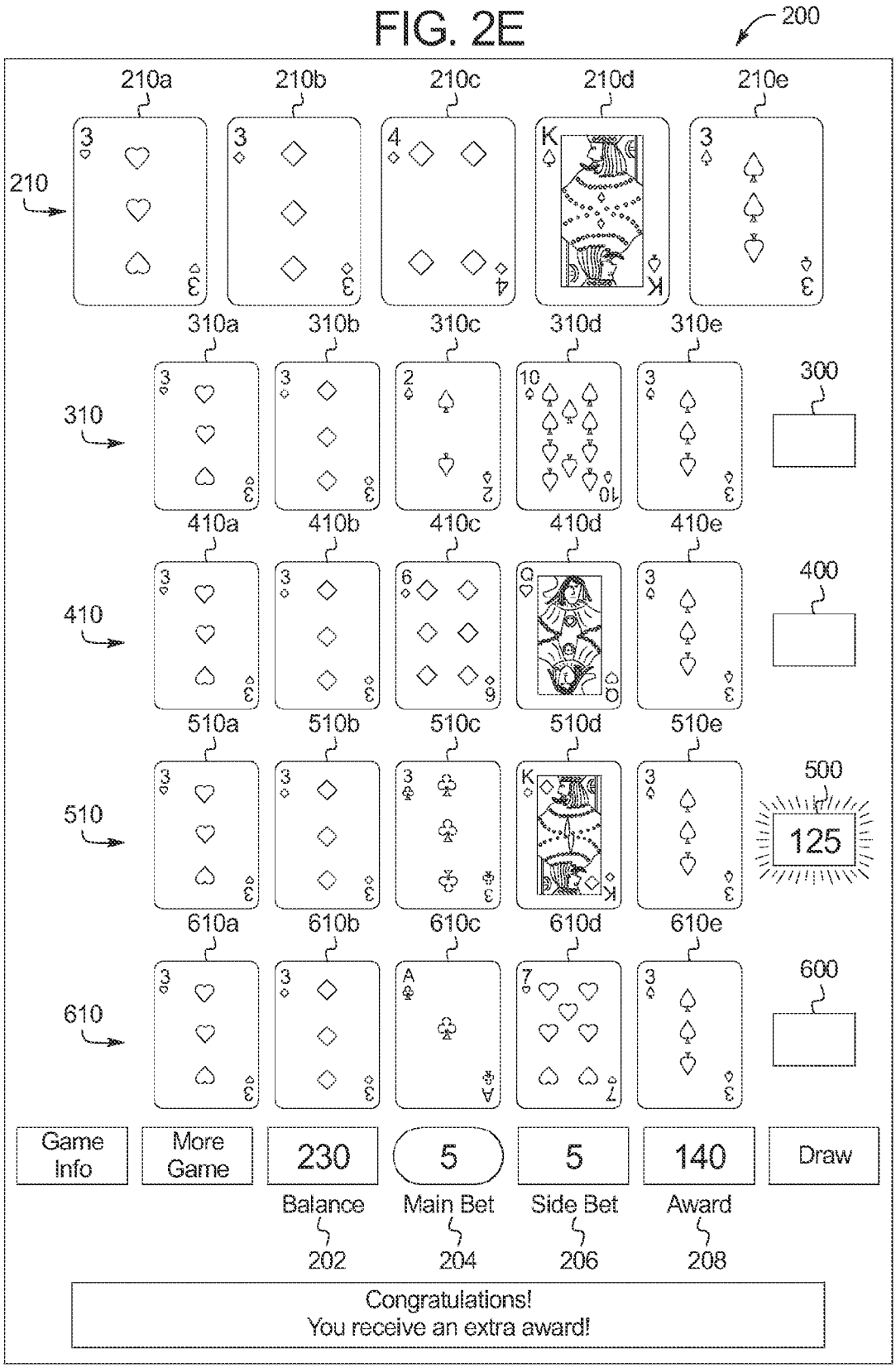

Turning now to FIG. 2E, the gaming system determines any extra winning card combination for each of the four extra hands of cards. The third extra hand of cards 510 includes the 3♣ and thus includes a new winning card combination of four-of-a-kind. The gaming system provides an additional award of 125 credits associated with the new winning card combination based on the example Jacks or Better paytable shown above as indicated by the extra award meter 500. The gaming system displays and provides the total award of 140 credits as indicated by award meter 208, which includes the award associated with the winning card combination of the first hand (i.e., 15 credits) and the extra award associated with the winning card combination of the third extra hand of cards (i.e., 125 credits).

Figure 3A:
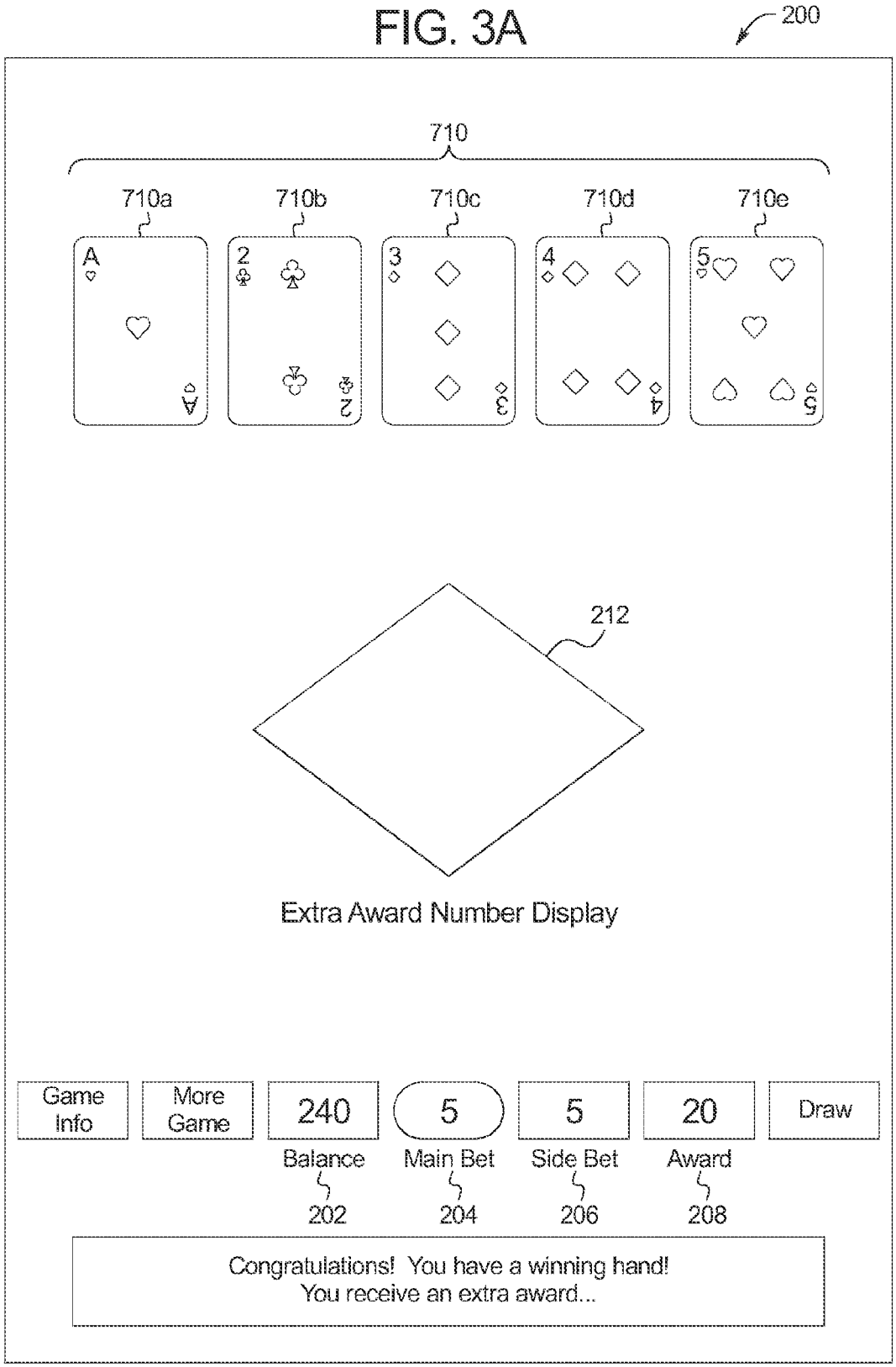
FIGS. 3A, 3B, and 3C illustrate screen shots of an example of one embodiment of the gaming system of the present disclosure providing a play of the card game with an extra award provided by one or more extra hands of cards or a multiplier according to the method of FIG. 1.
Figure 3B:
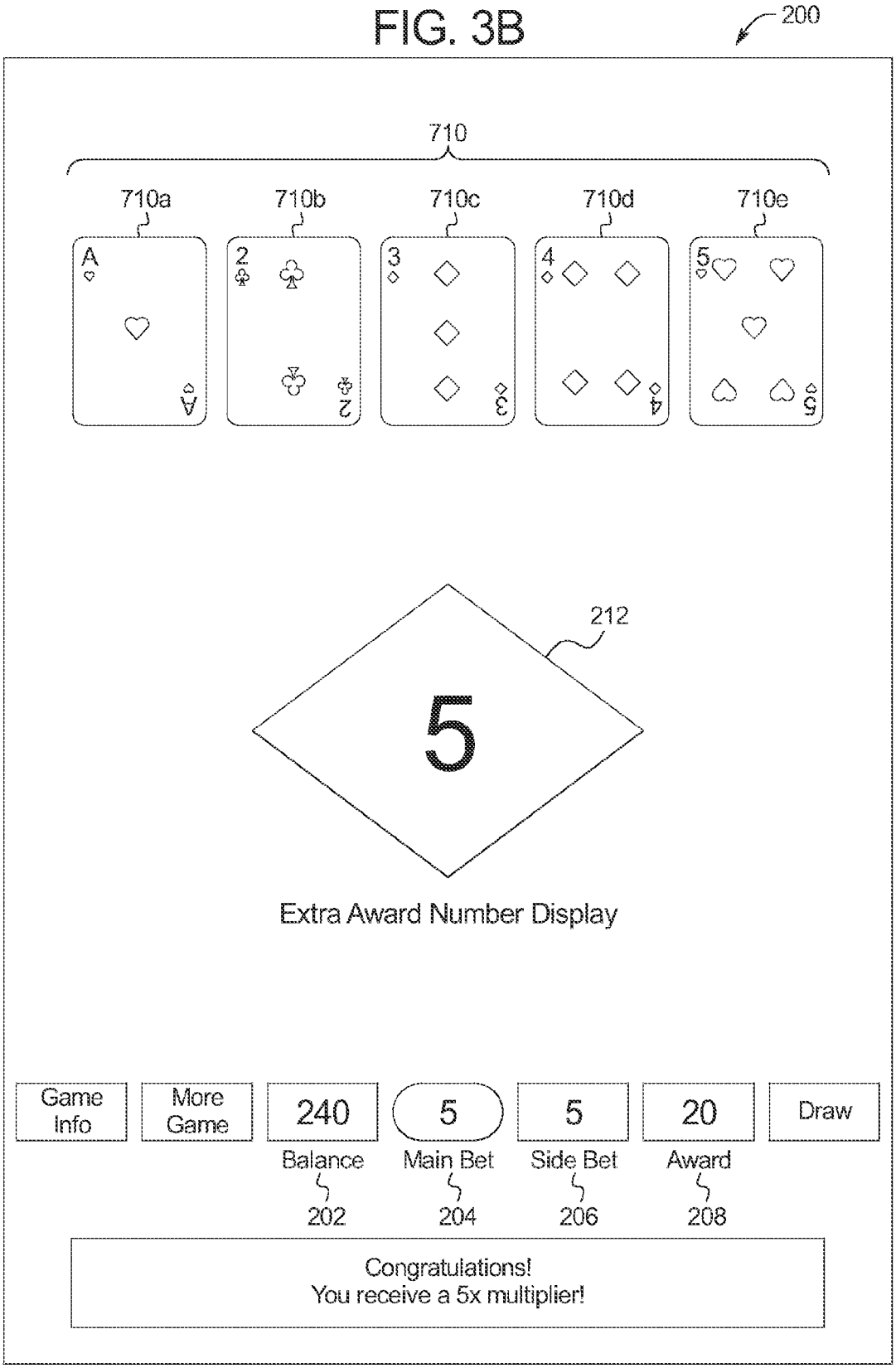
Figure 3C:
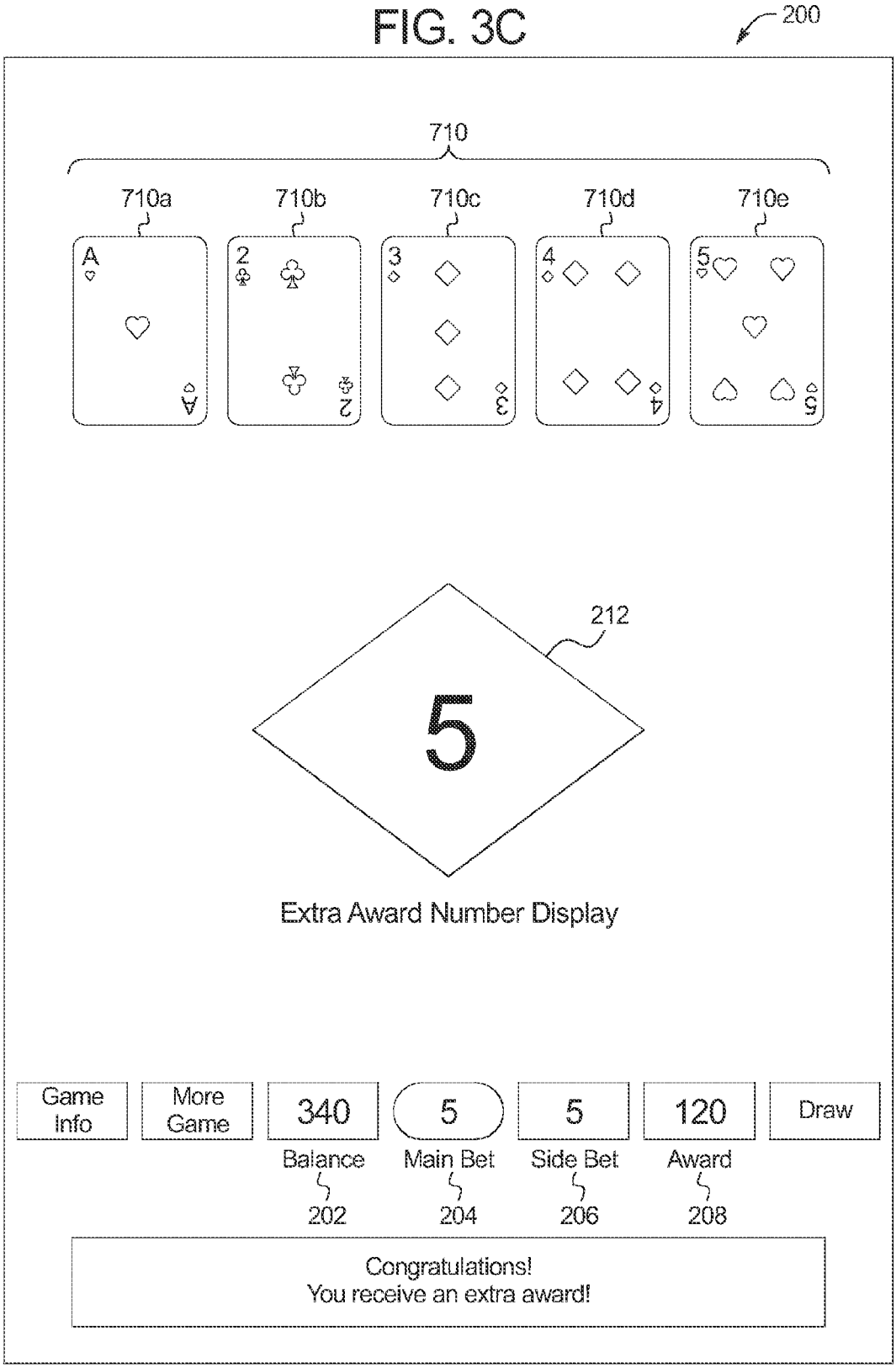

Turning now to FIGS. 3A, 3B, and 3C, which illustrate screen shots of a second play of the card game for the example embodiment of the present disclosure as described above with reference to FIGS. 2A, 2B, 2C, 2D, and 2E in accordance with method 100 described above with respect to FIG. 1.

As illustrated in FIG. 3A, upon receiving a primary wager 204 and secondary wager 206 from a player for a play of the card game, the gaming system randomly selects a first hand of cards 710 including five cards 710*a*, 710*b*, 710*c*, 710*d*, and 710*e* from a first virtual deck of 52 cards and displays the first hand of cards 710 face up as shown in the display 200. More specifically, in this example embodiment, the gaming system displays the first hand of cards 710 including the: A♥, 2♣, 3♦, 4♦, and 5♥, as indicated by 710*a*, 710*b*, 710*c*, 710*d* and 710*e*. In this example embodiment, the first hand of cards includes a straight, which is a winning card combination. Since the first hand includes a winning card combination associated with the straight based on the example Jacks or Better paytable, the gaming system provides and displays an award of 20 credits as indicated by award meter 208.

Turning to FIG. 3B, since the first hand includes a winning card combination, in this example embodiment, the winning card combination triggers the extra awards feature of the card game. The gaming system determines whether the winning card combination is from the first set of designated winning card combinations. In this example embodiment, the first hand of cards 710 includes a straight, which is a five-card winning card combination. Thus, in this example embodiment, the first hand of cards does not include any winning card combination from the first set of designated winning card combinations. The gaming system determines whether the first hand of cards includes any winning card combination from a second set of designated winning card combinations.

The second set of designated winning card combinations, in this embodiment, includes a second different predefined set of winning card combinations including a four-of-a-kind and any winning card combinations including all five cards of the hand. More specifically, the second set of designated winning card combinations includes a straight, flush, full house, four-of-a-kind, straight flush and royal flush. For winning card combinations from the second set of designated winning card combinations, the gaming system provides an award multiplier for an extra award. It should be appreciated that unlike the winning card combinations from the first set of designated winning card combinations, the second set of designated winning card combinations of this embodiment, include card combinations (i.e., four-of-a-kind and royal flush) that cannot be improved by an extra card from a standard deck of 52 cards. That is, without a wild card, winning card combinations such as a four-of-a-kind and a royal flush cannot be improved by an additional card from a standard deck of 52 cards. Thus, in this example embodiment, for winning card combinations from the second set of designated winning card combinations, the gaming system does not provide extra hands of cards with one or more extra draws for extra cards. Instead, the gaming system provides a multiplier to enhance the player's award. It should be appreciated that in certain alternative embodiments, the winning card combinations that can be improved, such as full-house, straight, flush, and straight flush, are not included in the second set of designated winning card combinations.

Since the first hand of cards includes a winning card combination from the second set of designated winning card combinations, the gaming system randomly determines a multiplier value to apply to the award associated with the winning card combination of the first hand of cards as shown by the extra award number display 212. In this example embodiment, the gaming system randomly determined a multiplier value of five as shown in the extra award number display 212.

Turning now to FIG. 3C, the player received an award of 20 credits associated with the winning card combination of the first hand. The gaming system randomly determined a 5× multiplier value for the extra award as indicated by 212. Thus, the gaming system applies the 5× multiplier to the award of 20 credits associated with the winning card combination of the first hand of cards for an extra award of 100 credits. Thus, the player's total award for this play of the card game is 120 credits. The total award includes the original award associated with the winning card combination (i.e., 20 credits) of the first hand of cards plus the extra award (i.e., 100 credits) or (5×+1) times the award associated with the winning card combination of the first hand.

It should be appreciated that for each play of the card game, the gaming system provides an opportunity for an extra award either by providing one or more extra hands or an award modifier (such as a multiplier) value of one or more applied to the player's award. This is very exciting for the player and will keep the player engaged.

Wager for the Extra Awards Feature

It should be appreciated that in certain alternative embodiments of the present disclosure, the main wager for the primary game funds the base game and the extra award feature, including the extra awards feature providing extra hands of cards and the award multiplier feature. In an alternative embodiment, the extra award feature may additionally or alternatively be employed as or in association with a bonus game or a secondary game upon receiving a side bet in addition to the primary wager for the base game. In one such embodiment, a player must place or wager a side bet to be eligible to receive the extra award including the extra hands of cards and the award multiplier associated with the side bet. In an alternative embodiment, the player must place the maximum bet and the side bet to be eligible to win the extra award including the extra hands of cards and the award multiplier.

Base Game

In the example embodiments described above, the gaming system employs a stud poker type base game. In various alternative embodiments of the present disclosure, the gaming system employs a draw poker type base card game for one or more plays of the card game of the present disclosure. More specifically, in one example embodiment, for a play of the card game, the gaming system: (a) randomly selects a first hand of cards including five cards from a first virtual deck of cards; (b) displays the first hand of cards including the five cards face up; (c) enables the player to select which cards to hold; (d) discards the remaining cards and replaces each discarded card with a replacement card from the virtual deck of cards; (e) evaluates the displayed first hand of cards for any winning card combinations; and (f) if the first hand of cards includes any winning card combinations, displays and provides the player an award associated with the winning card combination.

In various embodiments of the present disclosure, the gaming system employs a draw poker base game including an initial hand and a final hand of the first hand of cards. In certain embodiments, the extra award feature is triggered based on any designated winning card combination in the final hand of the first hand of cards. More specifically, in one example embodiment, if the final hand of the first hand of cards includes any winning card combination, the gaming system determines if the winning card combination is from the first set of designated winning card combinations. In this embodiment, if the winning card combination of the final hand of cards is from the first set of designated winning card combinations, the gaming system determines a quantity of extra hands of cards for the play of the card game. For each extra hand of cards in this example embodiment, the gaming system: (1) displays the cards from the winning card combination of the final hand of the first hand of cards; (2) completes the extra hand of cards with one or more extra cards from another virtual deck of cards, wherein a separate virtual deck of cards is used for each extra hand of cards; (3) determines any winning card combination in the extra hand of cards; and (4) displays any awards for any new winning card combination in each extra hand of cards. If the final hand of the first hand of cards includes any winning card combination from the second set of designated winning card combinations, the gaming system randomly generates a multiplier value to apply to the award associated with the winning card combination of the first hand of cards for an extra award and displays the extra award.

In various alternative embodiments, the extra award feature is triggered based on any designated winning card combination in the initial hand of the first hand of cards. More specifically, in one example of such an embodiment, the gaming system: (a) randomly selects an initial hand of cards from the first virtual deck of cards; (b) displays the initial hand of cards; and (c) determine any winning card combinations associated with the initial hand of cards. In this example embodiment, if the initial hand of cards includes any winning card combination from the first set of designated winning card combinations, the gaming system initiates the extra awards feature. The gaming system determines a quantity of extra hands of cards, and for each extra hand of cards: (1) displays the cards of the winning card combination associated with the initial hand of cards: (2) completes the extra hand of cards with at least one extra card from another virtual deck of cards; (3) determines any extra winning card combination for the extra hand of cards; and (4) displays any extra award for the extra hand of cards. In this example embodiment, if the initial hand of cards includes any winning card combination from the second set of designated winning card combinations, the gaming system randomly determines an award modifier (such as a multiplier value) to apply to the award associated with the winning card combination of the initial hand of cards, and displays the award.

Thereafter, the gaming system resumes the play of the initial hand of cards. The gaming system receives a selection of zero, one or a plurality of the cards in the initial hand of cards to hold and discards the remaining cards. The gaming system then replaces the discarded cards with replacement cards from the first virtual deck of cards for a final hand of cards, determines any winning card combinations associated with the final hand of cards, and displays any award for the final hand of cards. It should be appreciated that in this example embodiment, the gaming system pauses the play of the first hand of cards and completes the play of the extra hands of card before resuming the play of the first hand of cards. In certain alternative embodiments, the gaming system completes the play of the first hand of cards before initiating the extra award feature.

Designated Winning Card Combinations

In various embodiments of the present disclosure, the gaming system employs one or more sets of designated winning card combinations. In the example embodiments described above, the gaming system employs two sets of designated winning card combinations. More specifically, in the example embodiments described above, the gaming system employs a first set of designated winning card combinations including a predefined set of winning card combinations wherein the winning card combinations include less than five cards and wherein the winning card combinations can be improved with one or more additional cards based on a five-card paytable. For example, the first set of designated winning card combinations includes a pair, two pairs, and three-of-a-kind. If the first hand of cards includes any winning card combination from the first set of designated winning card combinations, the gaming system provides extra hands of cards. It should be appreciated that each extra hand of cards is an extra opportunity to achieve one or more additional cards that improve the winning card combination from the first hand of cards for an increased total award associated with a new winning card combination.

Additionally, in the example embodiments described above, the second set of designated whining card combinations includes a second different predefined set of winning card combinations including a four-of-a-kind and any winning card combinations including all five cards of the first hand. For example, in addition to a four-of-a-kind, the second set of designated winning card combinations includes a straight, flush, full house, four of a kind, straight flush and royal flush. It should be appreciated that in this embodiment, certain winning card combinations within the second set of designated winning card combinations cannot be improved (i.e., four-of-a-kind and royal flush) by dropping and redrawing one or more cards from a virtual deck of cards. As described in the example embodiment described above with reference to FIGS. 2A to 2E, if the first hand of cards includes any winning card combination from the second set of designated winning card combinations, the gaming system provides an award modifier (such as a multiplier value) to apply to the award associated with the winning card combination of the first hand of cards.

It should be appreciated that certain winning card combinations such as the full-house, straight, flush or the straight flush are winning card combinations that can be improved with an additional card from a virtual deck of cards. For example, a hand of cards including A♥, 2♦, 3♦, 4♦, and 5♦ includes a straight, which is a winning card combination with five cards can be improved to a flush or a straight flush by replacing the A♥. In this example embodiment, the straight is a winning card combination from the second set of designated winning card combinations. In certain alternative embodiments, the gaming system employs a third different set of designated winning card combinations that includes five-card winning card combinations that can be improved such as a full-house, straight, flush, and straight flush. In certain alternative embodiments, the gaming system employs more than three sets of predefined designated winning card combinations.

In certain alternative embodiments, the gaming system employs first and second sets of designated winning card combinations include sets of predefined winning card combinations that are different from the groups defined in the example embodiments above. It should be appreciated that in certain alternative embodiments, the gaming system uses a virtual deck of cards including wild cards. Thus, in certain alternative embodiments, winning card combinations such as a straight or a flush are more likely to benefit from an extra card than in embodiments with no wild cards.

In certain alternative embodiments, the gaming system employs only one set of designated winning card combinations including all winning card combinations. In one example of such an embodiment, the gaming system provides one or more extra hands of cards for all winning card combinations from the one designated set of winning card combinations. In this example embodiment, the winning card combination from the first hand of cards includes a four-of-a-kind and the gaming system provides four extra hands of cards. The gaming system, in this embodiment, displays four extra hands of cards and for each extra hand of cards, displays the four-of-a-kind winning card combination from the first hand of cards. The gaming system provides and displays an award for the winning card combination the four-of-a-kind) in each extra hand of cards.

It should be appreciated that the winning card combinations in the example embodiments described above are based on a standard five-card paytable. In certain alternative embodiments, the designated winning card combinations are based on a different paytable than the standard five-card paytable used in the example embodiments above. In one example embodiment, designated winning card combinations include a single high card such as an Ace.

Determining the Quantity of Extra Hands and the Modifier Value

In various embodiments of the present disclosure, the gaming system randomly determines the quantity of extra hands of cards and the modifier value for the extra award. In the example embodiments described above, the quantity of extra hands of cards and the modifier value is randomly determined. In various alternative embodiments the gaming system displays the randomly generated quantity of extra cards and modifier value such as by rolling a dice, spinning a wheel, or using another similar random number display.

It should be appreciated that in various embodiments of the present disclosure, the gaming system provides a quantity of extra hands of cards and an award modifier (such as a multiplier value) from a predefined range. In one example embodiment, the gaming system provides between one and five extra hands of cards and a multiplier value from 1× to 5×. In certain alternative embodiments, the gaming system provides a quantity of extra hands and an award modifier with a different predefined range. In another alternative embodiment, the award modifier range is based on the wager value.

In other alternative embodiments, the quantity of extra hands and the modifier value is predetermined for each play of the game. In certain alternative embodiments, the quantity of extra hands of cards and the modifier value is predetermined for a plurality of plays of the game within a gaming session.

Cards to Display for the Extra Hands of Cards

In various alternative embodiments, the present disclosure contemplates that the gaming system determines which cards to display for the extra hand of cards in a plurality of different ways. In certain alternative embodiments the gaming system displays the cards from the winning card combination of the first hand of cards. More specifically, in the example embodiments described above in reference to FIGS. 2A, 2B, 2C, 2D, and 2E, the first hand of cards includes the 3♥, 3♦, 4♦, K♠, and 3♠. Thus, in this example embodiment, for each extra hand of cards, the gaming system displays the 3♥, 3♦, and 3♠ and then completes each extra hand with additional cards from a virtual deck of cards.

In certain alternative embodiments, for each extra hand of cards, the gaming system determines which cards from the first hand of cards to carry over to the extra hands of cards based on optimal strategy. The optimal strategy is based on the greatest probability of achieving the greatest winning outcome for a given set of cards. That is, in certain alternative embodiments, the gaming system carries over the cards with the greatest probability of achieving an optimal winning outcome based on the optimal strategy. In one such example embodiment, in a Jacks or Better game, the first hand of cards includes the A♠, A♥, K♥, Q♥, and J♥. Although the pair of Aces is the winning card combination in this example embodiment, the gaming system automatically discards the A♠ because the optimal strategy for this set of cards is to hold the A♥, K♥, Q♥, and J♥ and draw to the Royal Flush. Thus, in this example embodiment, for each extra hand of cards, the gaming system will display the A♥, K♥, Q♥, and J♥ and randomly select an extra card to complete the extra hand.

In various alternative embodiments, the gaming system enables the player to select which cards to carry over for the extra hands of cards. More specifically, in one example embodiment, the first hand of cards includes the A♠, A♥, K♥, Q♥, and J♥. Thus, the player may select the A♠ and A♥ or the A♥, K♥, Q♥, and J♥. In another variation of this embodiment, the gaming system provides the player with the suggested optimal strategy and the gaming system provides the player with the option to override the gaming system's selection of cards to carry over.

In various alternative embodiments of the present disclosure, the gaming system employs a draw poker base game with an initial hand and a final hand of the first hand of cards. In various alternative embodiments, the extra award feature is triggered based on any designated winning card combination in the initial hand of the first hand of cards. More specifically, in one example embodiment, for a standard game of Jacks or Better draw poker, the initial hand of the first hand of cards includes A♠, A♥, K♥, Q♥, and J♥. In certain variations of these embodiments, for each extra hand of cards, the gaming system displays the winning card combination from the initial hand of cards (i.e., the A♠ and A♥). In other alternative embodiments, for each extra hand of cards, the gaming system displays cards from the first initial hand of cards based on the optimal strategy. In an example of this alternative embodiment, for a first hand of cards including A♠, A♥, K♥, Q♥, and J♥, the gaming system displays the A♥, K♥, Q♥, and J♥ for each extra hand of cards. It should be appreciated that in these two alternative embodiments, the gaming system determines which cards to display for each extra hand of cards regardless of which cards the player selects to hold for the final hand of the first hand of cards.

In certain alternative embodiments, the gaming system enables the player to select which cards to carry over for the extra hands of cards. More specifically, using the example described above, in one embodiment, for a standard game of Jacks or Better draw poker, the initial hand of the first hand of cards includes A♠, A♥, K♥, Q♥, and J♥. In this example embodiment, the player selects the A♥, K♥, Q♥, and J♥. Then, the gaming system in this embodiment enables the player to continue with the play of the first hand of cards by enabling the player to select which cards of the first initial hand to hold. In this example embodiment; for the first hand of cards, the player holds the A♠ and A♥. The gaming system of this example embodiment discards the remaining cards (i.e., K♥, Q♥, and J♥) and replaces the discarded cards with replacement cards from the virtual deck for a final hand of cards. In this example embodiment the final hand of cards includes A♠, A♥, 10♥, 2♥, and 10♠. It should be appreciated that the final hand of cards of this example embodiment includes a different winning card combination (i.e., two pairs) from the initial hand of cards. The gaming system provides the award associated with the two-pair winning card combination of the final hand of the first hand of cards. For each extra hand of cards of this example embodiment, the gaming system displays the A♥, K♥, Q♥, and J♥ and the gaming system completes each extra hand of cards with an extra card from a virtual deck of cards.

In certain alternative embodiments of the present disclosure, the gaming system provides the player with a suggested selection of which cards to hold based on optimal strategy. In certain variations of this embodiment, the gaming system enables the player to override the gaming system's selection for which cards of the first hand of cards to hold, but the gaming system employs the optimal strategy for the extra hands of cards. In certain alternative embodiments, the gaming system does not provide the player with the optimal strategy, but the extra hands of cards feature is only triggered if the player employs the optimal strategy.

In certain alternative embodiments, the extra award feature is triggered based on any designated winning card combinations in the final hand of the first hand of cards. More specifically, using the example described above, in one example embodiment, the gaming system first displays an initial hand of cards including the A♠, A♥, K♥, Q♥, and J♥. In this embodiment, the player holds the A♠ and A♥. The gaming system in this example embodiment discards the remaining cards (i.e., K♥, Q♥, and J♥) and replaces the discarded cards with replacement cards from the virtual deck for a final hand of cards. In this example embodiment the final hand of cards includes A♠, A♥, 10♥, 2♥, and 10♠. Thus, in this example embodiment, the cards carried over for the extra hand of cards must be from the final hand of cards including the A♠, A♥, 10♥, 2♥, and 10♠. In certain alternative embodiments, the gaming system displays the cards from the best winning card combination (i.e., A♠, A♥, 10♥, and 10♠) for each extra hand of cards. In certain alternative embodiments, the gaming system determines which cards of the final hand of cards to display for the extra hands of cards based on optimal strategy. In other alternative embodiments, the gaming system enables the player to select which cards from the final hand of cards to display for each extra hand of cards.

Virtual Deck of Cards for Each Extra Hand

In various embodiments of the present disclosure such as the example embodiment described above in reference to FIGS. 2A to 2E, the gaming system uses identical separate virtual decks of a reduced quantity of cards to complete each of the extra hands of cards. In this example embodiment, the gaming system randomly selects a first hand of cards from a first virtual deck of 52 cards. For each extra hand of cards in this example embodiment, the gaming system uses another virtual deck of cards excluding the cards from the winning card combination of the first hand. More specifically, the gaming system in this example embodiment, randomly selects the first hand of cards including the 3♥, 3♦, 4♦, K♠, and 3♠ from a first virtual deck of 52 cards. The winning card combination includes the 3♥, 3♦, and 3♠. In this example embodiment, the gaming system displays four extra hands of cards and for each extra hand of cards, the gaming system initially displayed three cards from the first hand of cards (i.e., 3♥, 3♦, and 3♠). In this example embodiment, the gaming system randomly selects two extra cards for each of the four extra hands of cards to complete the extra hand of cards. In this example embodiment, the gaming system completes each extra hand of cards with two cards from a separate virtual deck of 49 cards excluding the 3♥, 3♦, and 3♠. It should be appreciated that in this example embodiment, the gaming system uses a separate independent deck of 49 cards for each extra hand of cards. In an alternative embodiment, all five cards from the first hand of cards are removed from the virtual deck of cards used for each extra hand of cards. More specifically, in one such embodiment, using the example first hand of cards described above, the gaming system completes each extra hand of cards two cards from a separate virtual deck of 47 cards excluding the 3♥, 3♦, 4♦, K♠, and 3♠. It should be appreciated that in this example embodiment, the player does not have the possibility of redrawing the 4♦ and K♠.

In certain alternative embodiments, the gaming system uses the same single virtual deck of 49 cards to complete all of the extra hands of cards. It should be appreciated that in embodiments where the gaming system uses a single deck of cards to complete all extra hands of cards, there is a greater probability for at least one of the hands of displaying an additional card that improves the winning card combination from the first hand of cards.

Award for Each Extra Hand

In various embodiments of the present disclosure the gaming system provides an extra award for any designated winning card combination from a predefined set of designated winning card combinations. In the example embodiments described above with reference to FIGS. 2A, 2B, 2C, 2D, and 2E, the gaming system provides two sets of designated winning card combinations. In that example embodiment, for winning card combinations from the first set of designated winning card combinations, the gaming system provides an extra award by providing extra hands of cards. In that example embodiment, for winning card combinations from the second set of designated winning card combinations, the gaming system provides an extra award by providing an award multiplier value to be applied to the award for the winning card combination of the first hand of cards.

In certain alternative embodiments, the gaming system provides more than two sets of designated winning card combinations. In one such example embodiment, the gaming system provides extra hands of cards for winning card combinations from two sets of designated winning card combinations. In other alternative embodiments, the gaming system provides an extra award by providing an award multiplier for winning card combinations from two sets of designated winning card combinations. In another alternative embodiment, the gaming system provides only one set of designated winning card combinations and provides extra award by providing extra hands of cards for all designated winning card combinations. In certain alternative embodiments, the gaming system provides the player the option of choosing the form of the extra award. More specifically, if the first hand of cards includes a winning card combination, the gaming system enables the player to select either extra hands of cards or a multiplier.

In various embodiments of the present disclosure, such as the example embodiment described above in references to FIGS. 2A to 2E, the gaming system evaluates each hand of cards using the same five-card paytable for the first hand of cards and each extra hand of cards. In certain alternative embodiments, the gaming system uses a first five-card paytable to evaluate the first hand of cards and a different five-card paytable to evaluate one or more of the extra hands of cards.

In certain various alternative embodiments of the present disclosure, the gaming system provides an extra award for each winning card combination in the extra hands of cards. More specifically, in one example embodiment, the first hand of cards includes 3♥, 3♦, 4♦, K♠, and 3♠. The winning card combination from the first hand is 3♥, 3♦, and 3♠, which is from the first set of designated winning card combinations. In this example embodiment, the gaming system provides an award associated with the winning card combination of the first hand of cards and randomly determines that the player receives four extra hands of cards. The four extra hands of cards are as follows: (a) 3♥, 3♦, 2♠, 10♠, and 3♠; (b) 3♥, 3♦, 6♦, Q♥, and 3♠; (c) 3♥, 3♦, 3♣, K♦, and 3♠; and (d) 3♥, 3♦, A♣, 7♥, and 3♠. The third extra hand of cards (c) includes a new winning card combination: 3♥, 3♦, 3♣, and 3♠. In various embodiments of the present disclosure, using this example, the gaming system provides an extra award associated with each of the four extra hands of cards because each of the extra four hands of cards includes at least the winning card combination (i.e., 3♥, 3♦, and 3♠) from the first hand of cards. In this example embodiment, since the third extra hand of cards includes a different winning card combination with a greater award, the gaming system provides the greater award for that hand. In certain alternative embodiments, the gaining system provides an extra award associated with any new winning card combinations in the extra hands of cards. More specifically, using the example described above, the gaming system provides an award associated with the winning card combination in the first hand of cards and an extra award associated with any new winning card combination in the extra hand of cards. In this example embodiment, the gaming system would provide an extra award associated with the third extra hand of cards including the 3♥, 3♦, 3♣, and 3♠ because that extra hand includes a new different winning card combination from the first hand of cards.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
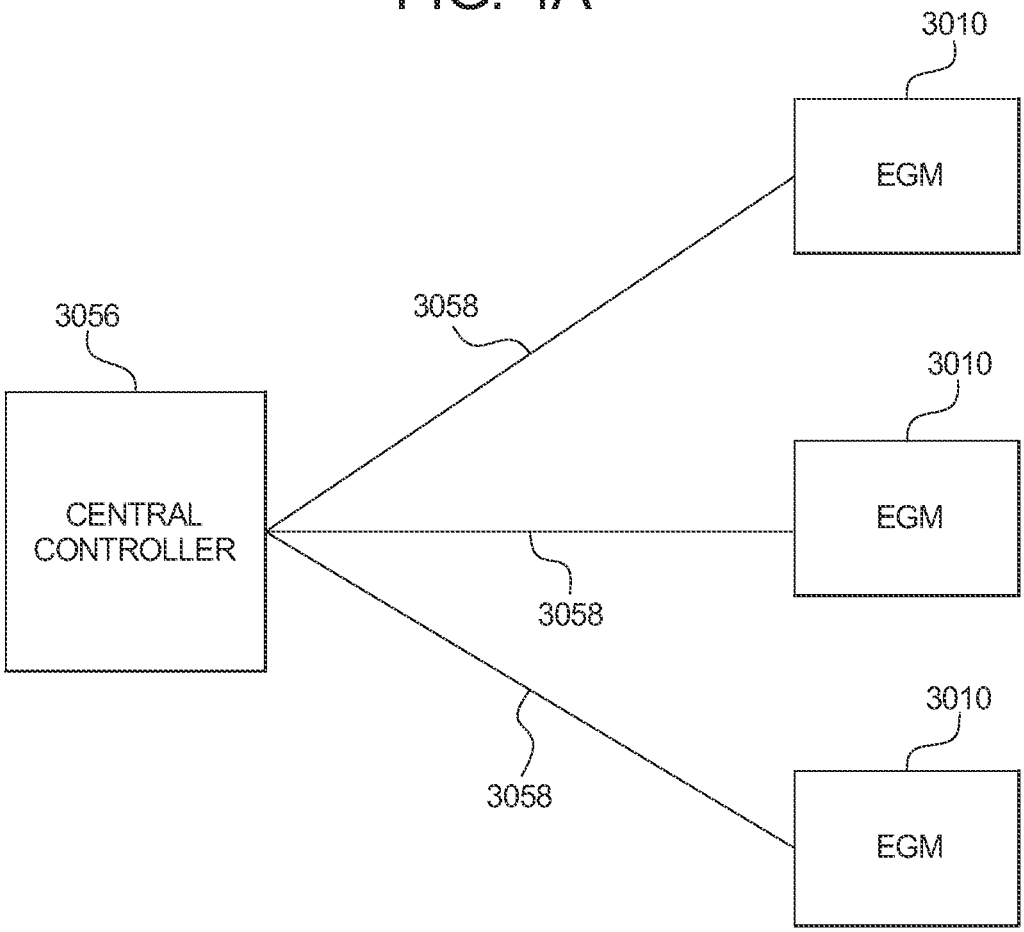
FIG. 4A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 3010 that are each configured to communicate with a central server, central controller, or remote host 3056 through a data network 3058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
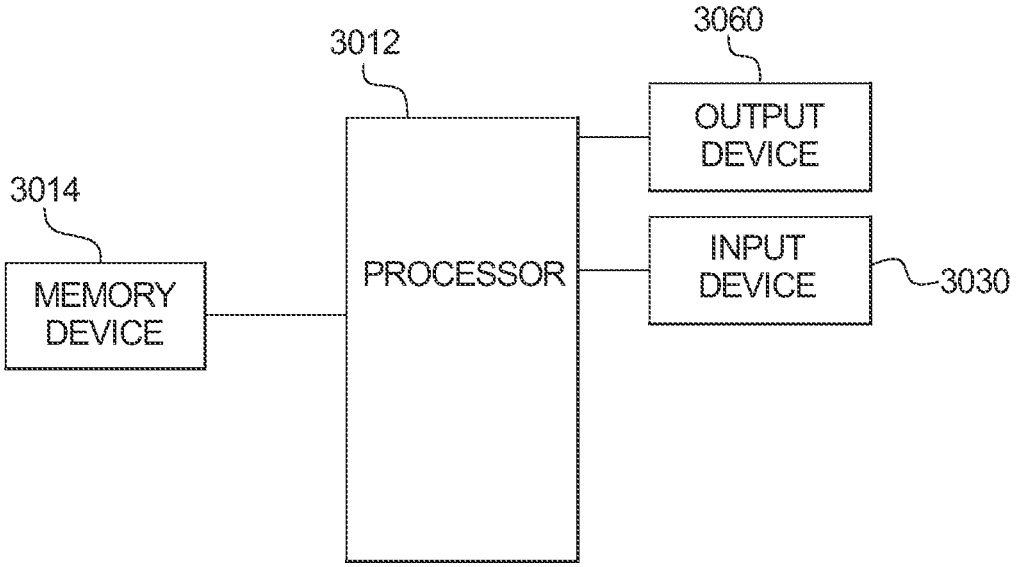
FIG. 4B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 3012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 3014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
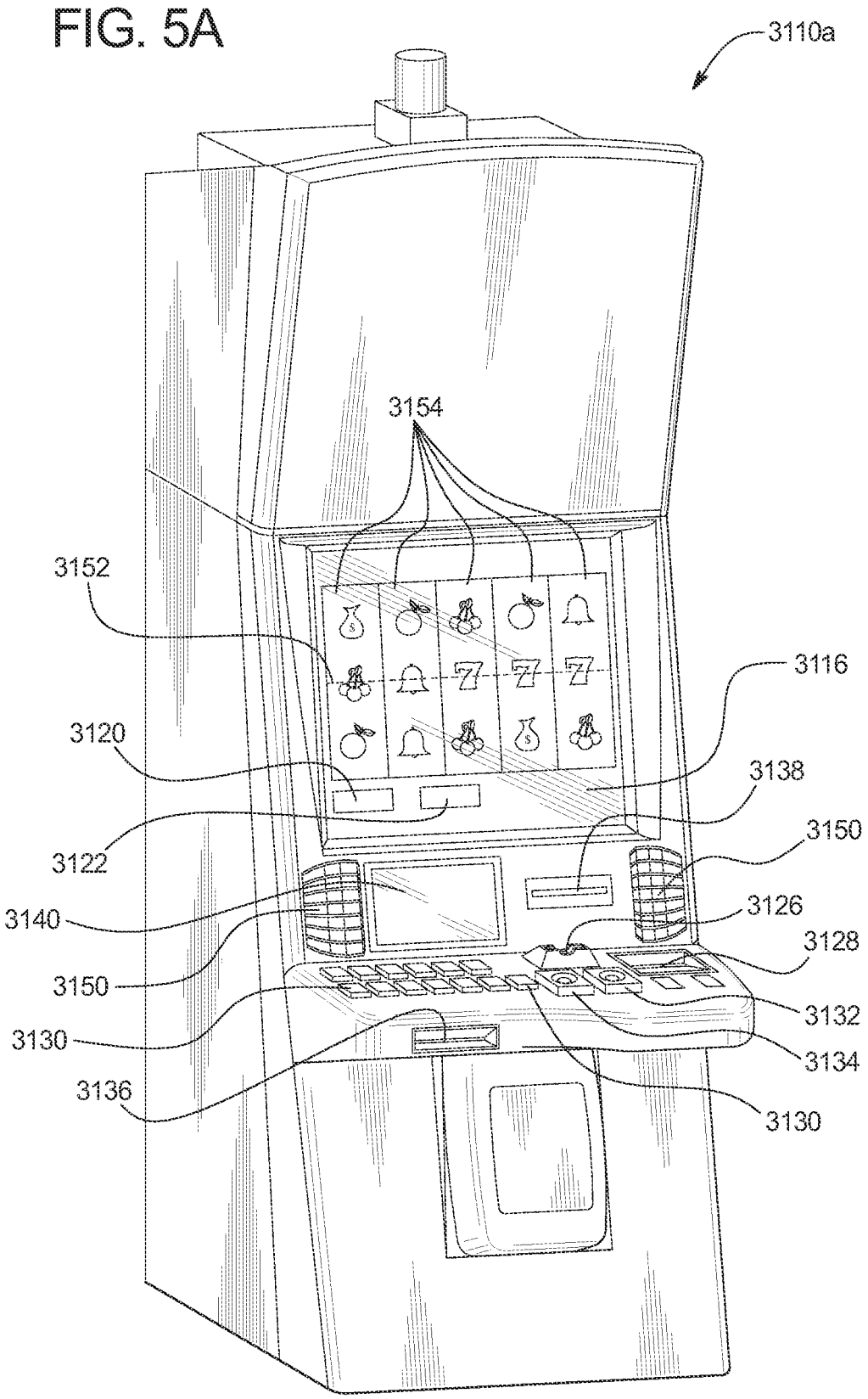
FIGS. 5A and 5B are perspective views of example alternative embodiments of the gaming system of the present disclosure.
Figure 5B:
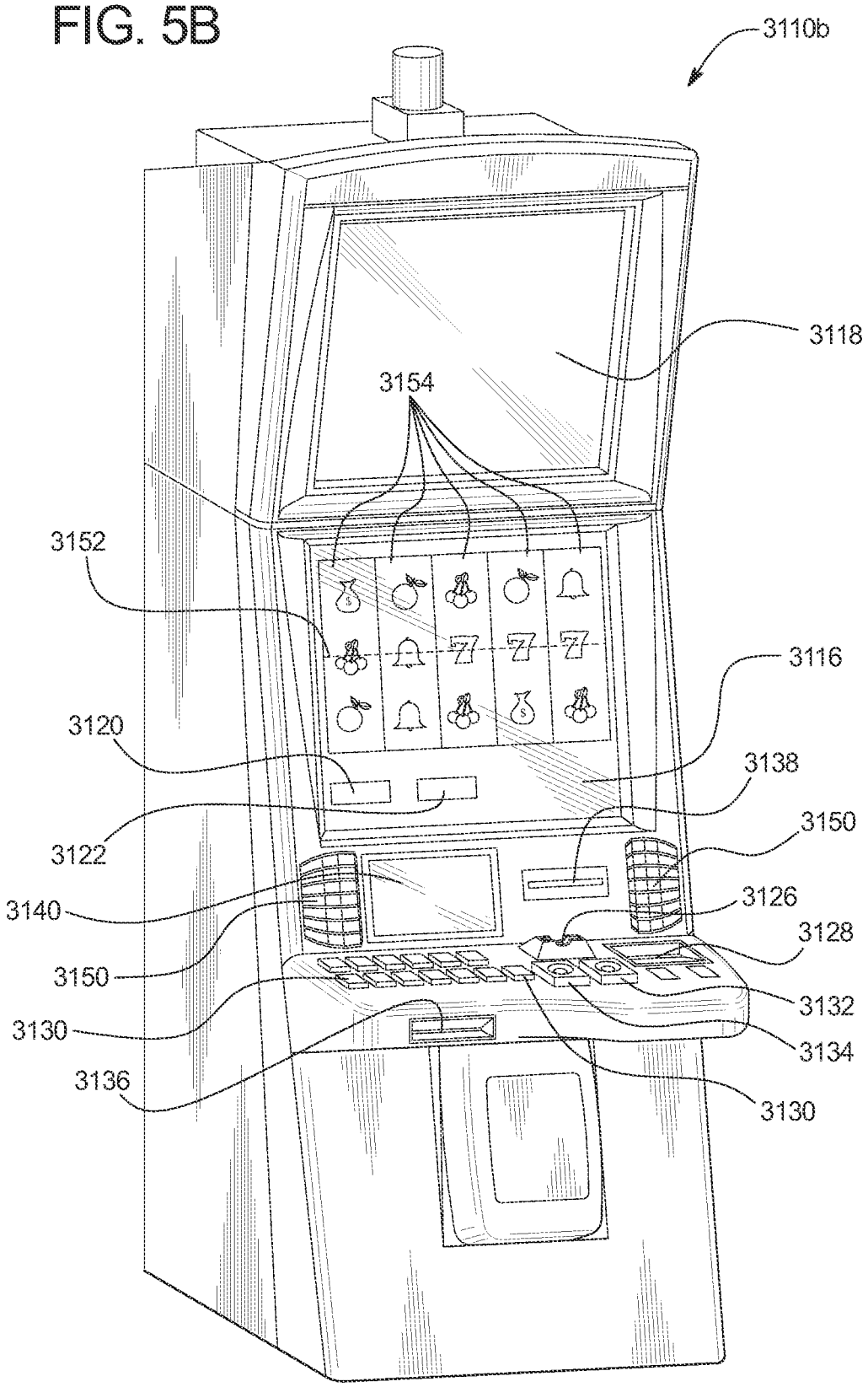

In various embodiments, the EGM includes one or more input devices. The input devices may include any suitable device that enables an input signal to be produced and received by the at least one processor of the EGM. The example EGM illustrated in FIG. 4B includes at least one input device 3030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 3128, and (b) a coin slot 3126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 3132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 3134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 3138. The card reader is configured to read a player identification card inserted into the card reader.

In various embodiments, the EGM includes one or more output devices. The example EGM illustrated in FIG. 4B includes at least one output device 3060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 3116, a player tracking display 3140, a credit display 3120, and a bet display 3122. The example EGM illustrated in FIG. 5B includes a central display device 3116, an upper display device 3118, a player tracking display 3140, a player tracking display 3140, a credit display 3120, and a bet display 3122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 3136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 3150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 53, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electromechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 5A and 5B include a payline 3152 and a plurality of reels 3154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

at least one processor;

at least one display device;

a plurality of input devices including an acceptor; and at least one memory device storing a plurality of instructions which, when executed by the at least one processor, cause the at least one processor to:

responsive to a physical item being received via the acceptor, establish a credit balance based on a monetary value associated with the received physical item;

for a play of a game:

randomly select a first hand of cards from a first virtual deck of cards;

cause the at least one display device to display the first hand of cards;

determine any winning card combinations associated with the first hand of cards;

cause the at least one display device to display any award associated with the winning card combination, wherein the credit balance is increasable based on any award associated with the winning card combination; and responsive to the first hand of cards including any winning card combination from a first set of designated winning card combinations:

randomly determine one of a plurality of different quantities of extra hands of cards;

responsive to the randomly determined quantity of extra hands of cards being one extra hand of cards, for the extra hand of cards:

cause the at least one display device to display one or more cards from the first hand of cards;

complete said extra hand of cards with at least one extra card from another virtual deck of cards;

determine any extra winning card combination for said extra hand of cards; and cause the at least one display device to display any award for said extra hand of cards, wherein the credit balance is increasable based on any award for said extra hand of cards; and responsive to the randomly determined quantity of extra hands of cards being more than one extra hand of cards, for each of the extra hands of cards:

cause the at least one display device to display one or more cards from the first hand of cards;

complete said extra hand of cards with at least one extra card from another virtual deck of cards, wherein each of the completed extra hands of cards are at least partially simultaneously displayed by the at least one display device;

determine any extra winning card combination for said extra hand of cards; and cause the at least one display device to display any award for said extra hand of cards, wherein the credit balance is increasable based on any award for said extra hand of cards; and responsive to a cashout input being received, cause an initiation of any payout associated with the credit balance.

2. The gaming system of claim 1, wherein when executed by the at least one processor responsive to the first hand of cards including any winning card combination from a second set of designated winning card combinations, the plurality of instructions cause the at least one processor to:

randomly determine an award modifier value to apply to the award for the winning card combination of the first hand of cards for a second award, and cause the at least one display device to display the second award.

3. The gaming system of claim 1, wherein the random selection of the first hand of cards includes:

randomly selecting an initial hand of cards from the first virtual deck of cards;

causing the at least one display device to display the initial hand of cards;

receiving a selection, via the at least one input device, of zero, one or a plurality of the cards in the initial hand to hold and discard the remaining cards; and replacing the discarded cards with replacement cards from the first virtual deck of cards for a final hand of cards.

4. The gaming system of claim 3, wherein when executed by the at least one processor responsive to the randomly selected initial hand of cards including any winning card combination from the first set of designated winning card combinations, the plurality of instructions cause the at least one processor to, for each extra hand of cards, cause the at least one display device to display one or more cards from the initial hand of cards.

5. The gaming system of claim 1, wherein the first set of designated winning card combinations includes a predefined set of winning card combinations.

6. The gaming system of claim 5, wherein the predefined set of winning card combinations includes any winning card combination for the play of the game.

7. The gaming system of claim 1, wherein when executed by the at least one processor responsive to the first hand of cards including any winning card combination from the first set of designated winning card combinations, the plurality of instructions cause the at least one processor to, for each extra hand of cards, cause the at least one display device to display the cards of the winning card combination associated with the first hand of cards.

8. The gaming system of claim 1, wherein the first virtual deck of cards is different from the virtual deck of cards used to complete the at least one of the extra hands of cards.

9. The gaming system of claim 8, wherein the virtual deck of cards used to complete at least one of the extra hands of cards is the virtual deck of cards excluding the cards from the first hand of cards displayed for the extra hand of cards.

10. A method of operating a gaming system, said method comprising:

randomly selecting, by at least one processor, a first hand of cards from a first virtual deck of cards;

causing a display, by at least one display device, of the first hand of cards;

determining, by the at least one processor, any winning card combinations associated with the first hand of cards;

causing a display, by the at least one display device, of any award associated with the winning card combination, wherein a credit balance is increasable based on any award associated with the winning card combination, said credit balance being increasable via an acceptor of a physical item associated with a monetary value, and said credit balance being decreasable via a cashout device; and responsive to the first hand of cards including any winning card combination from a first set of designated winning card combinations:

randomly determining, by the at least one processor, one of a plurality of different quantities of extra hands of cards;

responsive to the randomly determined quantity of extra hands of cards being one extra hand of cards, for the extra hand of cards:

causing a display, by the at least one display device, of one or more cards from the first hand of cards;

completing, by the at least one processor, said extra hand of cards with at least one extra card from another virtual deck of cards;

determining, by the at least one processor, any extra winning card combination for said extra hand of cards; and causing a display, by the at least one display device, of any award for said extra hand of cards, wherein the credit balance is increasable based on any award for said extra hand of cards; and responsive to the randomly determined quantity of extra hands of cards being more than one extra hand of cards, for each of the extra hands of cards:

causing a display, by the at least one display device, of one or more cards from the first hand of cards;

completing, by the at least one processor, said extra hand of cards with at least one extra card from another virtual deck of cards, wherein each of the completed extra hands of cards are at least partially simultaneously displayed by the at least one display device determining, by the at least one processor, any extra winning card combination for said extra hand of cards; and causing a display, by the at least one display device, of any award for said extra hand of cards, wherein the credit balance is increasable based on any award for said extra hand of cards.

11. The method of claim 10, further comprising, responsive to the first hand of cards including any winning card combination from a second set of designated winning card combinations:

randomly determining, by the at least one processor, an award modifier value to apply to the award for the winning card combination of the first hand of cards for a second award; and causing a display, by the at least one display device, of the second award.

12. The method of claim 10, further comprising, for the random selection of the first hand of cards:

randomly selecting, by the at least one processor, an initial hand of cards from the first virtual deck of cards;

causing a display, by the at least one display device, of the initial hand of cards;

receiving a selection of zero, one or a plurality of the cards in the initial hand to hold and discard the remaining cards; and replacing, by the at least one processor, the discarded cards with replacement cards from the first virtual deck of cards for a final hand of cards.

13. The method of claim 12, further comprising, responsive to the randomly selected initial hand of cards includes any winning card combination from the first set of designated winning card combinations, for each extra hand of cards, causing a display, by the at least one display device, of one or more cards from the initial hand of cards.

14. The method of claim 10, wherein the first set of designated winning card combinations includes a predefined set of winning card combinations.

15. The method of claim 14, wherein the predefined set of winning card combinations includes any winning card combination for the play of the game.

16. The method of claim 10, further comprising, responsive to the first hand of cards including any winning card combination from the first set of designated winning card combinations, for each extra hand of cards, causing a display, by the at least one display device, of the cards of the winning card combination associated with the first hand of cards.

17. The method of claim 10, wherein the first virtual deck of cards is different from the virtual deck of cards used to complete at least one of the extra hands of cards.

18. The gaming system of claim 17, wherein the virtual deck of cards used to complete the at least one of the extra hands of cards is the virtual deck of cards excluding the cards from the first hand of cards displayed for the extra hand of cards.

19. The method of claim 10, which is provided through a data network.

20. The method of claim 19, wherein the data network is an internet.

21. A gaming system comprising:

at least one processor separate from a mobile device; and at least one memory device storing a plurality of instructions which, when executed by the at least one processor, cause the at least one processor to:

responsive to receiving data associated with a credit balance established responsive to an electronic funds transfer initiated from the mobile device, for a play of a game:

randomly select a first hand of cards from a first virtual deck of cards;

communicate data which results in a display device of the mobile device displaying the first hand of cards;

determine any winning card combinations associated with the first hand of cards;

communicate data which results in the display device of the mobile device displaying any award associated with the winning card combination, wherein the credit balance is increasable based on any award associated with the winning card combination; and responsive to the first hand of cards including any winning card combination from a first set of designated winning card combinations:

randomly determine one of a plurality of different quantities of extra hands of cards;

responsive to the randomly determined quantity of extra hands of cards being one extra hand of cards, for the extra hand of cards:

communicate data which results in the display device of the mobile device displaying one or more cards from the first hand of cards;

complete said extra hand of cards with at least one extra card from another virtual deck of cards;

determine any extra winning card combination for said extra hand of cards; and communicate data which results in the display device of the mobile device displaying any award for said extra hand of cards, wherein the credit balance is increasable based on any award for said extra hand of cards; and responsive to the randomly determined quantity of extra hands of cards being more than one extra hand of cards, for each of the extra hands of cards:

communicate data which results in the display device of the mobile device displaying one or more cards from the first hand of cards;

complete said extra hand of cards with at least one extra card from another virtual deck of cards, wherein each of the completed extra hands of cards are at least partially simultaneously displayed by the display device of the mobile device;

determine any extra winning card combination for said extra hand of cards; and communicate data which results in the display device of the mobile device displaying any award for said extra hand of cards, wherein the credit balance is increasable based on any award for said extra hand of cards.

22. The gaming system of claim 21, wherein responsive to the first hand of cards including any winning card combination from a second set of designated winning card combinations, randomly determine an award modifier value to apply to the award for the winning card combination of the first hand of cards for a second award and display the second award.

23. The gaming system of claim 21, wherein the random selection of the first hand of cards includes:

randomly selecting an initial hand of cards from the first virtual deck of cards;

communicate data which results in the display device of the mobile device displaying the initial hand of cards;

receiving a selection of zero, one or a plurality of the cards in the initial hand to hold and discard the remaining cards; and replacing the discarded cards with replacement cards from the first virtual deck of cards for a final hand of cards.

24. The gaming system of claim 21, wherein when executed by the processor, the plurality of instructions cause the processor to communicate with the mobile device via a wireless network.

25. The gaming system of claim 21, wherein the electronic funds transfer is from a bank account.

* * * * *